US008262209B2

(12) United States Patent
Nitta et al.

(10) Patent No.: US 8,262,209 B2
(45) Date of Patent: Sep. 11, 2012

(54) CIRCULATING TYPE INK SUPPLY SYSTEM

(75) Inventors: Noboru Nitta, Tagata-gun (JP); Takanori Gomi, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 257 days.

(21) Appl. No.: 12/471,018

(22) Filed: May 22, 2009

(65) Prior Publication Data

US 2009/0295888 A1 Dec. 3, 2009

Related U.S. Application Data

(60) Provisional application No. 61/056,533, filed on May 28, 2008, provisional application No. 61/056,556, filed on May 28, 2008.

(51) Int. Cl.
*B41J 2/18* (2006.01)

(52) U.S. Cl. ..... 347/89

(58) Field of Classification Search ..... None
See application file for complete search history.

(56) References Cited

U.S. PATENT DOCUMENTS

| | | | | |
|---|---|---|---|---|
| 7,097,287 | B2 * | 8/2006 | Nakao et al. | 347/85 |
| 7,128,406 | B2 | 10/2006 | Dixon et al. | |
| 7,597,434 | B2 * | 10/2009 | Nitta et al. | 347/89 |
| 2006/0132554 | A1 | 6/2006 | Ota et al. | |
| 2008/0158321 | A1 | 7/2008 | Nitta et al. | |
| 2008/0273064 | A1 | 11/2008 | Ota et al. | |

FOREIGN PATENT DOCUMENTS

| | | | |
|---|---|---|---|
| JP | 2000-211154 | | 8/2000 |
| WO | WO 2006030235 | A2 * | 3/2006 |
| WO | WO 2006064040 | A1 * | 6/2006 |

OTHER PUBLICATIONS

Japanese Office Action for Japanese Application No. 2009-126626 mailed on Jul. 3, 2012.

* cited by examiner

*Primary Examiner* — Matthew Luu
*Assistant Examiner* — Erica Lin
(74) *Attorney, Agent, or Firm* — Turocy & Watson, LLP

(57) ABSTRACT

A circulating type ink supply system includes an upstream ink tank, an upstream ink flow channel connected at one end thereof to the upstream ink tank, a nozzle branch portion connected to the other end of the upstream ink flow channel and being in communication with a nozzle configured to discharge ink, a downstream ink flow channel connected at one end thereof to the nozzle branch portion and a downstream ink tank connected to the other end of the downstream ink flow channel, wherein an energy per unit volume determined by a sum value of a static pressure and a potential energy of the ink in the upstream ink tank when the circulation of the ink is stopped does not exceed the energy per unit volume of the ink at an atmospheric pressure at a level of the nozzle.

19 Claims, 12 Drawing Sheets

Calculation of nozzle pressure during circulation in experimental ink supply system

| | | |
|---|---|---|
| | | SUS tube ~ 802a |
| Diameter d | 7mm | 0.007 m |
| Circumferential length s | | 0.021991 m |
| Cross sectional area A | | 3.85E−05 m2 |
| Tube friction coefficient ratio k | | 1 |
| Flow channel resistance per viscosity length | | 1.7E+10 m−4 |
| Tube length | | 200 mm |
| Flow channel resistance per viscosity | | 3.39E+09 m−3 |
| | | 802b |
| Flow channel resistance of circular tube | | Interior of first fitting |
| Diameter d | 6.4mm | 0.0064 m |
| Circumferential length (wet edge length) s | | 0.020106 m |
| Cross sectional area A | | 3.22E−05 m2 |
| Tube friction coefficient ratio k | | 1 |
| Flow channel resistance per viscosity length | | 2.43E+10 m−4 |
| Tube length L | | 9.9 mm |
| Flow channel resistance per viscosity | | 2.4E+08 m−3 |
| | | 802c |
| Flow channel resistance of circular tube | | Interior of second fitting |
| Diameter d | 4mm | 0.004 m |
| Circumferential length (wet edge length) s | | 0.012566 m |
| Cross sectional area A | | 1.26E−05 m2 |
| Tube friction coefficient ratio k | | 1 |
| Flow channel resistance per viscosity length | | 1.59E+11 m−4 |
| Tube length L | | 16.6 mm |
| Flow channel resistance per viscosity | | 2.64E+09 m−3 |
| | | 802d |
| Flow channel resistance of circular tube | | In-fitting tube |
| Diameter d | 3mm | 0.003 m |
| Circumferential length (wet edge length) s | | 0.009425 m |
| Cross sectional, area A | | 7.07E−06 m2 |
| Tube friction coefficient ratio k | | 1 |
| Flow channel resistance per viscosity length | | 5.03E+11 m−4 |
| Tube length L | | 30 mm |
| Flow channel resistance per viscosity | | 1.51E+10 m−3 |
| | | 802e |
| Flow channel resistance of circular tube | | Teflon tube |
| Diameter d | 4mm | 0.004 m |
| Circumferential length (wet edge length) s | | 0.012566 m |
| Cross sectional area A | | 1.26E−05 m2 |
| Tube friction coefficient ratio k | | 1 |
| Flow channel resistance per viscosity length | | 1.59E+11 m−4 |
| Tube length L | | 100 mm |
| Flow channel resistance per viscosity | | 1.59E+10 m−3 |

Calculate theoretical value of flow channel resistance per viscosity.

Flow channel resistance R(Pa・s/m3) is proportional to viscosity $\mu$(Pa・s) and coefficient of proportion (flow channel resistance per viscosity, 1/m3) is determined by shape of flow channel. If reynolds number is small, flow channel resistance of tube having cross-section area A (m2), wet edge length s (m), and tube length L (m) is R(Pa・s/m3) =2k (S2/A3)・L・$\mu$. However, with circular tube, tube friction coefficient ratio is k=1. In this embodiment, reynolds number is sufficiently small.

FIG. 7

Potential pressure (potential head difference pressure) calculation

| | |
|---|---|
| 9.8 N/kg | Gravitational acceleration |
| 1050 kg/m3 | Specific gravity of ink |
| −0.01 m | Potential head difference |
| −102.9 Pa | Negative pressure |

Actual measurement | Setting

Ink viscosity 10mPa・s | Circulating flow rate 30mL/min 5E−07 m3/s

| Actual measurement | Flow channel resistance | | Pressure loss Pa |
|---|---|---|---|
| Upstream in head ~501a | 1.97E+11 m−3 | 1.97E+09 Pas/m3 | 985 Pa |
| SUS tube ~802a ~802b | 3393891331 m−3 | 33938913 Pas/m3 | 16.96946 Pa |
| Interior of a first fitting | 240422658.8 m−3 | 2404227 Pas/m3 | 1.202113 Pa |
| Interior of a second fitting | 2641972055 m−3 | 26419721 Pas/m3 | 13.20988 Pa |
| In-fitting tube 802c | 15090246456 m−3 | 1.51E+08 Pas/m3 | 75.46123 Pa |
| Teflon tube 802d 802e | 15915494309 m−3 | 1.59E+08 Pas/m3 | 79.57747 Pa |
| Sum | 6276286045 m−3 | 62762860 Pas/m3 | 1171.41 Pa |

Potential head difference −10mm → −0.01m → −1171.41 Pa, −102.9 Pa

Nozzle pressure during circulation → −1274.31 Pa

Print: When discharged flow rate 10 mL/min is superimposed on circulating flow rate 30mL/min Ink viscosity 10mPa・s | Upstream flow rate 40mL/min 6.67E−07 m3/s

| | Flow channel resistance | | Pressure loss Pa |
|---|---|---|---|
| Upstream in head 501a | 1.97E+11 m−3 | 1.97E+09 Pas/m3 | 1313.333 Pa |
| SUS tube ~802a ~802b | 3393891331 m−3 | 33938913 Pas/m3 | 22.62594 Pa |
| Interior of a first fitting | 240422658.8 m−3 | 2404227 Pas/m3 | 1.602818 Pa |
| Interior of a second fitting | 2641972055 m−3 | 26419721 Pas/m3 | 17.61315 Pa |
| In-fitting tube 802c | 15090246456 m−3 | 1.51E+08 Pas/m3 | 100.6015 Pa |
| Teflon tube 802d 802e | 15915494309 m−3 | 1.59E+08 Pas/m3 | 106.1033 Pa |
| Sum | 6276286045 m−3 | 62762860 Pas/m3 | 1581.88 Pa |

Potential head difference −10mm −0.01m −1551.88 Pa, −102.9 Pa

Nozzle pressure during circulation → −1664.78 Pa

| | | |
|---|---|---|
| Pressure change during printing job | 390.47 Pa | Breakdown |
| Internal pressure loss of head 501a | 328.3333 Pa | |
| Pressure loss of SUS tube 802a or the like | 82.13671 Pa | |

FIG. 8

CIRCULATING TYPE INK SUPPLY SYSTEM

CROSS-REFERENCE TO RELATED APPLICATION

This application claims the benefit of U.S. Provisional Applications No. 61/056,533, filed on May 28, 2008 and No. 61/056,556, filed on May 28, 2008.

TECHNICAL FIELD

The present invention relates to a circulating type ink supply technology used in an ink jet printing apparatus.

BACKGROUND

In the related art, in a circulating type ink supply system applied to an ink jet printing apparatus, positional relationships between nozzles and a liquid level of an upstream pressure source and a liquid level of a downstream pressure source are set. The liquid level of the upstream pressure source is set to a position higher than the nozzles. The liquid level of the downstream pressure source is set to a position lower than the nozzles. The circulating type ink supply system circulates ink according to the level difference between the upstream pressure source and the downstream pressure source. The circulating type ink supply system is needed to maintain the pressure applied to ink in the vicinity of nozzle openings adequately.

In the circulating type ink supply system, it is necessary to select the positions of the upstream pressure source and the downstream pressure source so as to maintain the ink pressure at a nozzle position both during circulation and when the circulation is stopped adequately. Consequently, the physical arrangement of the upstream pressure source and the downstream pressure source in the ink jet printing apparatus is difficult. In the circulating type ink supply system, the length of tubes which connect the upstream pressure source with the nozzles and the downstream pressure source with the nozzles is increased, so that the ink pressure at the nozzle position is instable. In addition, there is a problem such as upsizing of the circulating type ink supply system.

The invention provides a circulating type ink supply system in which the pressure applies to ink in the vicinity of nozzle openings is adequately maintained.

SUMMARY

According to one aspect of the invention, there is provided a circulating type ink supply system comprising: an upstream ink tank, an upstream ink flow channel connected at one end thereof to the upstream ink tank; a nozzle branch portion connected to the other end of the upstream ink flow channel and being in communication with a nozzle configured to discharge ink; a downstream ink flow channel connected at one end thereof to the nozzle branch portion; a downstream ink tank connected to the other end of the downstream ink flow channel and configured to store the ink flowed from the upstream ink tank via the upstream ink flow channel, the nozzle branch portion, and the downstream ink flow channel; a feedback flow channel configured to return the ink in the downstream ink tank to the upstream ink tank; a circulating mechanism configured to circulate the ink stored in the upstream ink tank from the upstream ink flow channel through the nozzle branch portion, the downstream ink flow channel, the downstream ink tank, and the feedback flow channel to the upstream ink tank; and a printing mechanism configured to discharge the ink branched at the nozzle branch portion from the nozzle for printing, in which an energy per unit volume which is determined by a sum value of a static pressure and a potential energy of the ink in the upstream ink tank when the circulation of the ink is stopped does not exceed the energy per unit volume of the ink at an atmospheric pressure at a level of the nozzle.

DESCRIPTION OF THE DRAWINGS

FIG. 7 is a table showing theoretical values of a flow channel resistance with respect to shapes of components of the upstream ink flow channel and calculated viscosities according to the embodiment.

FIG. 8 is a table showing pressure loss calculated on the upstream side of an ink jet head of the circulating type ink supply system according to the embodiment.

DETAILED DESCRIPTION

Figure 1:
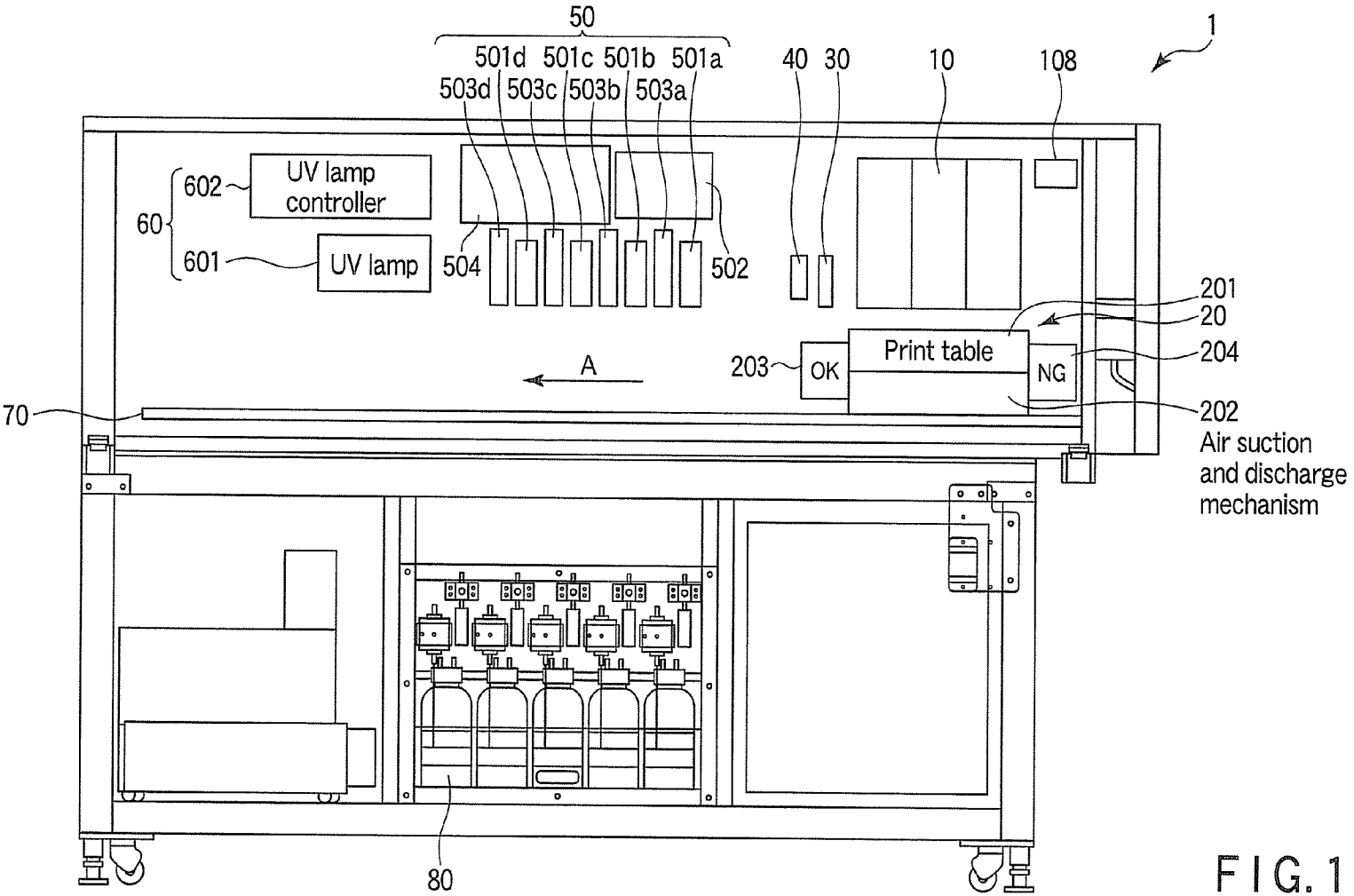
FIG. 1 is a cross-sectional front view of an ink jet printing apparatus to which a circulating type ink supply system according to an embodiment is applied.

Referring to the drawings, an embodiment will be described below.

Figure 2:
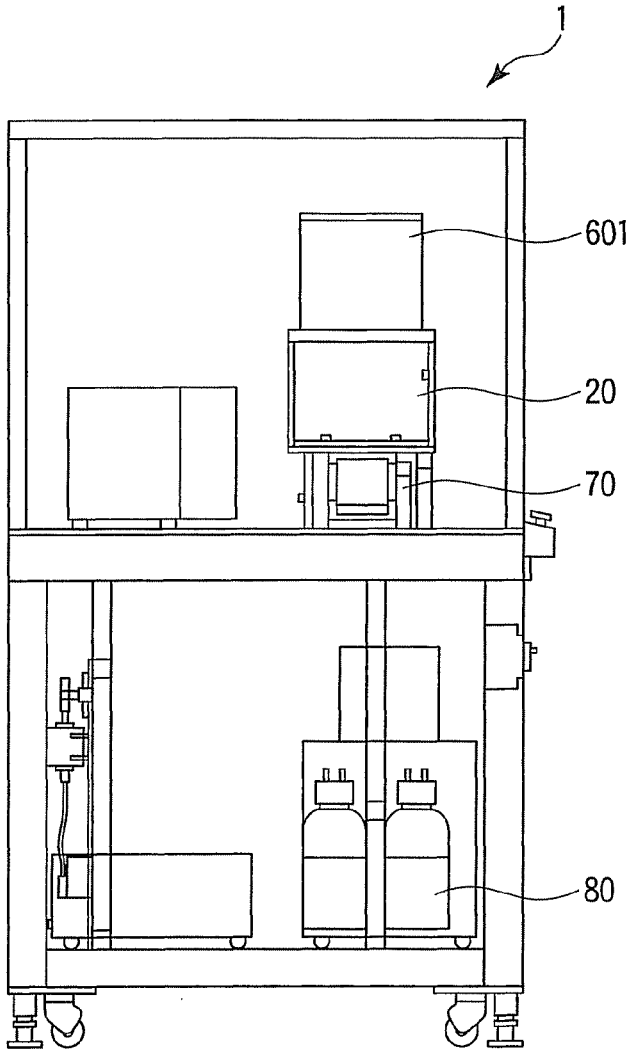
FIG. 2 is a cross-sectional side view of the ink jet printing apparatus to which the circulating type ink supply system according to the embodiment is applied.

FIG. 1 is a cross-sectional front view of an ink jet printing apparatus 1 to which a circulating type ink supply system 2 according to the embodiment is applied. FIG. 2 is a cross-sectional side view of the ink jet printing apparatus 1 to which the circulating type ink supply system 2 according to the embodiment is applied. Here, description will be given about an ink jet printing apparatus configured to print on a printing medium p (referred to as a non-penetration medium p) through which ink does not penetrate such as a thick paper or a card.

The ink jet printing apparatus 1 mainly includes a media setting mechanism 10, a carriage 20, a media collecting mechanism 30, a media set sensing mechanism 40, a printing unit 50, a main curing portion 60, a carrying unit 70, and a main tank 80. The media setting mechanism 10 sets the non-penetration medium p in the media set sensing mechanism 40.

The carriage 20 carries the non-penetration medium p set by the media setting mechanism 10 with the carrying unit 70. The carrying unit 70 carries the non-penetration medium p along a carrying direction (hereinafter, defined as a direction A) directed from the media setting mechanism 10 side toward the printing unit 50. The carriage 20 includes a printing table 201, an air intake and exhaust mechanism 202, a first media collecting box 203, and a second media collecting box 204. The printing table 201 is a member to place the non-penetration medium p. The air intake and exhaust mechanism 202 adsorbs or separates the non-penetration medium p to or from the printing table 201.

The first media collecting box 203 is provided in front of the carriage 20 in terms of the direction A. The first media collecting box 203 is configured to store the normally printed non-penetration media p. The second media collecting box 204 is provided behind the carriage 20 in terms of the direction A. The second media collecting box 204 is a member to store the non-penetration media p other than the normally printed non-penetration medium p.

The media collecting mechanism 30 is provided between the media setting mechanism 10 and the printing unit 50. The media collecting mechanism 30 collects the non-penetration media p on which images are normally printed in the first media collecting box 203. The media collecting mechanism 30 collects the non-penetration medium p other than the normally printed non-penetration media p in the second media collecting box 204.

The media set sensing mechanism 40 is provided between the media setting mechanism 10 and the printing unit 50. In this embodiment, it is provided on the downstream side of the media setting mechanism 10 in terms of the direction A. The media set sensing mechanism 40 determines whether or not the non-penetration medium p is placed at a predetermined position on the printing table 201 normally.

The printing unit 50 includes ink jet heads 501*a*, 501*b*, 501*c*, and 501*d*, a printing port 502, a temporary curing UV lamps 503*a*, 503*b*, 503*c*, and 503*d*, and a temperature adjusting unit 504. The ink jet heads 501*a* to 501*d* each are a head configured to discharge ink in one of four colors of C, M, Y, and K. The ink jet heads 501*a* to 501*d* are arranged along the direction A. Here, for example, the ink jet head 501*a* discharges the ink K, the ink jet head 501*b* discharges the ink Y, the ink jet head 501*c* discharges the ink M, and the ink jet head 501*d* discharges the ink C. The printing port 502 controls the amount of ink and a timing to be discharged from the ink jet heads 501*a* to 501*d* on the basis of image data transmitted from a PC 100 as an external apparatus. In this embodiment, UV cured ink which is cured when irradiated with UV rays is employed.

The temporary curing UV lamp 503*a* is provided between the ink jet head 501*a* and the ink jet head 501*b* along the direction A. Likewise, the temporary curing UV lamp 503*b* is provided between the ink jet head 501*b* and the ink jet head 501*c*, the temporary curing UV lamp 503*c* is provided between the ink jet head 501*c* and the ink jet head 501*d*, and the temporary curing UV lamp 503*d* is provided immediately downstream side of the ink jet head 501*d*.

The temporary curing UV lamp 503*a* starts to irradiate immediately after the non-penetration medium p is printed by the ink jet head 501*a*. It is the same for the temporary curing UV lamps 503*b* to 503*d*. The ink on the surface of the non-penetration medium p starts to be cured by the temporary curing UV lamps 503*a* to 503*d*. The ink on the surface of the non-penetration medium p is not completely cured but in a temporarily cured state because the luminous energies of the temporary curing UV lamps 503*a* to 503*d* are weak. The temperature adjusting unit 504 adjusts the luminous energies to be applied from the temporary curing UV lamps 503*a* to 503*d*.

The main curing portion 60 includes a main curing UV lamp 601 and a UV lamp control apparatus 602. The main curing UV lamp 601 irradiates the non-penetration medium p with an UV ray at a higher luminous energy than the temporary curing UV lamps 503*a* to 503*d*. The main curing UV lamp 601 cures the ink on the surface of the non-penetration medium p completely after being printed with all the ink jet heads 501*a* to 501*d*. The ink on the surface of the non-penetration medium p is brought into a fixed state with respect to the non-penetration medium p. The UV lamp control apparatus 602 adjusts the luminous energy and the timing of irradiation.

The main tank 80 is provided below the printing unit 50. The main tank 80 is provided with the ink to be supplied to the ink jet heads 501*a* to 501*d*.

Figure 3:
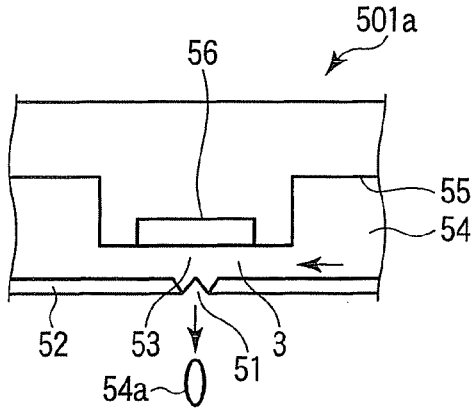
FIG. 3 is a cross-sectional view of an ink jet head according to the embodiment.

Subsequently, configurations of the ink jet heads 501*a* to 501*d* to be applied to the circulating type ink supply system 2 according to the embodiment will be described below. Here, although the ink jet head 501*a* will be described as an example, the description is applied also to other ink jet heads 501*b* to 501*d*. FIG. 3 is a cross-sectional view of the ink circulating type ink jet head 501*a*. The ink jet head 501*a* is formed with nozzle branch portions 53 on the side of an upper surface of an orifice plate 52 having nozzles 51 for discharging ink.

The nozzle branch portions 53 are formed by narrowing midsections of an in-head flow channel 55 where ink 54 passes. The nozzle branch portions 53 each include the nozzle 51 and an actuator 56 on the surface opposing to the nozzle 51. The ink 54 flows in the in-head flow channel 55 from the right side (upstream side) to the left side (downstream side) in the drawing through the nozzle branch portions 53. The nozzle branch portions 53 are connecting points of a flow channel where the ink 54 flows from the upstream side to the downstream side and a flow channel where the ink 54 flows toward the nozzle 51.

When the actuators 56 are activated, the ink 54 in the nozzle branch portions 53 are discharged from the nozzles 51 as ink drops 54*a*. A known type of the actuator 56 is a piezoelectric system in which a piezoelectric element such as a PZT is used to directly or indirectly deform a pressure chamber 3. In addition, the ink jet head 501*a* may be of any type such as the one which activates a diaphragm with static electricity, a thermal system which heats the ink 54 by a heater to generate air-bubbles and generate a pressure, or a system to move the ink 54 directly by the static electricity.

The positions to provide the above-described actuators 56 do not have to be on the surface opposing to the nozzle 51, but may be, for example, on the surface located in the depth direction in the drawing. What is essential is that the each nozzle branch portion 53 is in communication with the each nozzle 51 so that the ink 54 is discharged from the nozzles 51 when the actuators 56 generate a pressure at the nozzle branch portions 53. The actuators 56 do not necessarily have to be provided at the nozzle branch portions 53. They may be provided between the nozzle branch portions 53 and the nozzles 51.

Figure 4:
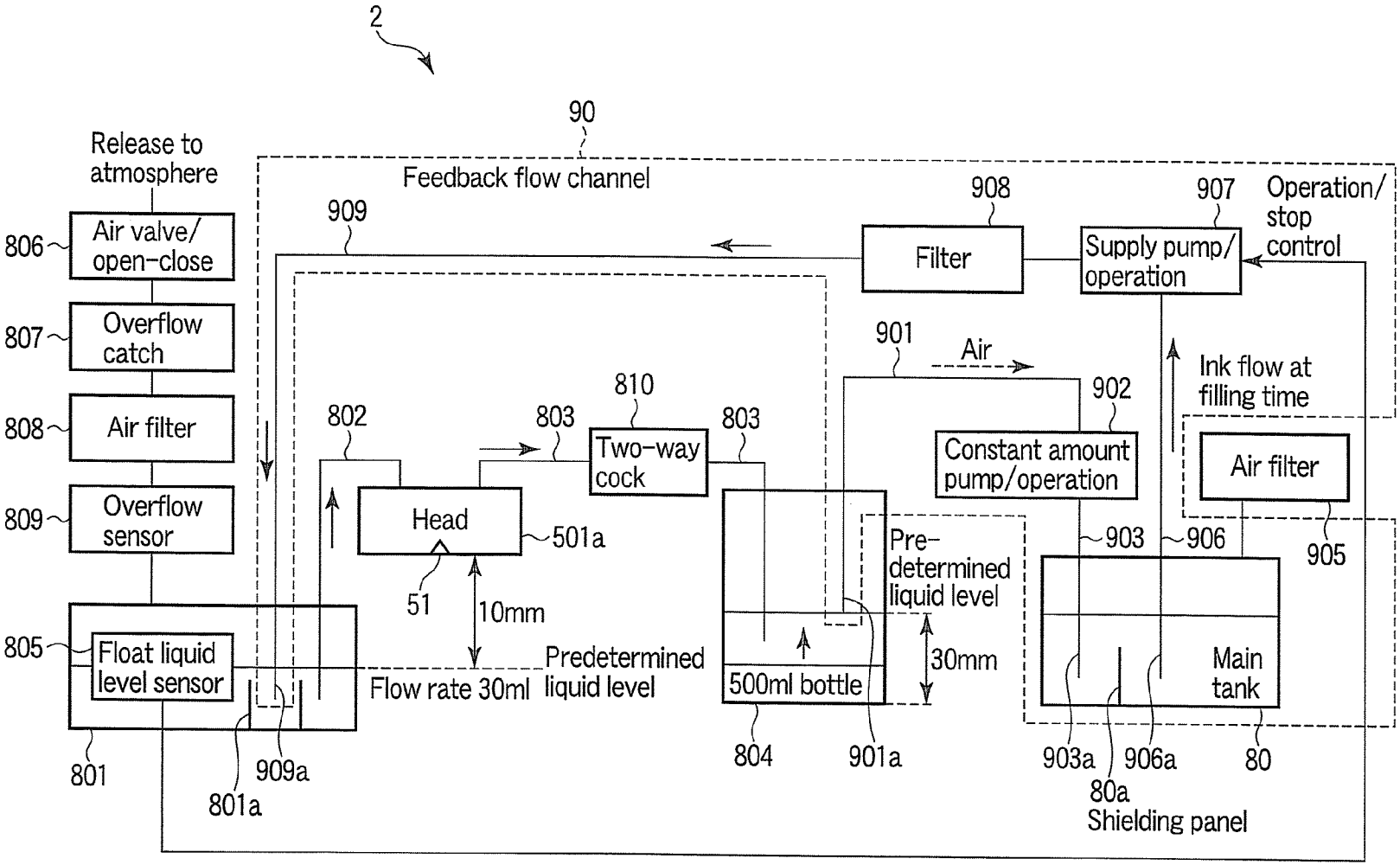
FIG. 4 is a block diagram of the circulating type ink supply system according to the embodiment.

Referring now to FIG. 4, a configuration of the circulating type ink supply system 2 applied to the ink jet printing apparatus 1 according to the embodiment will be described.

The circulating type ink supply system 2 mainly includes an upstream ink tank 801, an upstream ink flow channel 802, the ink jet head 501*a*, a downstream ink flow channel 803, a downstream ink tank 804, and a feedback flow channel 90. The upstream ink flow channel 802 is a flow channel which connects the upstream ink tank 801 and the ink jet head 501*a*. The downstream ink flow channel 803 is a flow channel which connects the ink jet head 501*a* and the downstream ink tank 804. The feedback flow channel 90 is a flow channel which connects the downstream ink tank 804 and the upstream ink tank 801.

The upstream ink tank 801 is a hermetically closable container in which the ink 54 to be supplied to the nozzle branch portions 53 of the ink jet head 501*a* is stored. The upstream ink tank 801 includes a float liquid level sensor 805 integrated therein. The float liquid level sensor 805 detects a displacement between a liquid level of the ink 54 stored in the upstream ink tank 801 and a predetermined position of the liquid level. Here, the predetermined position of the liquid level is a position 10 mm below the positions of the openings of the nozzles 51 of the ink jet head 501*a* in the height direction.

The feedback flow channel 90 includes a first flow channel 901, a constant amount pump 902, a second flow channel 903, the main tank 80, a third flow channel 906, a supply pump 907, a filter 908, and a fourth flow channel 909. The main tank 80 includes an air filter 905. The constant amount pump 902 determines a flow rate of the ink 54 to be flowed to the circulating type ink supply system 2. The main tank 80 stores the ink 54 to be fed back to the upstream ink tank 801. The supply pump 907 feeds the ink 54 from the main tank 80 to the upstream ink tank 801 so that the liquid level of the upstream ink tank 801 is maintained constant at the predetermined position of the liquid level.

The first flow channel 901 is a flow channel which connects the downstream ink tank 804 and the constant amount pump 902. The first flow channel 901 on the side of the downstream ink tank 804 includes an intake port 901*a*. The second flow channel 903 is a flow channel which connects the constant amount pump 902 and the main tank 80. The air filter 905 prevents foreign substances from entering the main tank 80, which is released to the atmosphere. The third flow channel 906 is a flow channel which connects the main tank 80 and the supply pump 907. The fourth flow channel 909 is a flow channel which connects the supply pump 907 and the upstream ink tank 801. The filter 908 provided at a predetermined position in the fourth flow channel 909 removes the foreign substances from the ink 54 flowing from the main tank 80 into the upstream ink tank 801.

Here, the constant amount pump 902 feeds the ink 54 via the downstream ink tank 804 as a buffer tank at a constant flow rate. The downstream ink tank 804 is a hermetically closed damper bottle.

The upstream ink tank 801 includes an air valve 806, an overflow catch 807, an air filter 808, and an overflow sensor 809. The air valve 806 releases the upstream ink tank 801 to the atmosphere when being opened from a closed state. The overflow catch 807 and the overflow sensor 809 prevent the ink 54 from overflowing from the air valve 806 released to the atmosphere when an abnormality occurs in the circulating type ink supply system 2. When some abnormalities occur in the circulating type ink supply system 2 and ink 59 is about to overflow from the air valve 806 provided on the upstream ink tank 801, the overflow sensor 809 detects this event.

When the overflow sensor 809 senses the overflow of the ink 54, a control unit 200 stops the operation of the supply pump 907. The overflow catch 807 receives the ink 59 overflowing from the air valve 806 provided on the upstream ink tank 801. The ink 54 does not overflow to the outside from the air valve 806 provided on the upstream ink tank 801 released to the atmosphere. The air filter 808 prevents the foreign substances from entering the upstream ink tank 801 via the air valve 806 released to the atmosphere.

A two-way cock 810 is provided at a given position in the downstream ink flow channel 803 which connects the ink jet head 501*a* and the downstream ink tank 804. When the two-way cock 810 is in an opened state, the ink 54 in the ink jet head 501*a* flows to the downstream ink tank 804. When the two-way cock 810 is in the closed state, the ink 54 in the ink jet head 501*a* does not flow to the downstream ink tank 804.

Here, a unit $N \cdot m/m^3$ of "energy per unit volume" in which the reference of "energy per unit volume" is the ink 54 at an atmospheric pressure at a position of the openings of the nozzles 51 in the height direction is equivalent to Pa (Pascal). The "energy per unit volume" corresponds to the "energy per unit volume" of "Bernoulli's expression", and is the sum value of a static pressure, a dynamic pressure, and a potential pressure. In the description given below, the reference magnitude of the potential pressure is the position of the openings of the nozzle 51 in the height direction unless otherwise specifically noted.

When the dynamic pressure can be ignored, the "energy per unit volume" at the liquid surface of the ink 54 in the upstream ink tank 801 is expressed by the sum value of the static pressure of the liquid surface of the ink 54 in the upstream ink tank 801 and the potential pressure of "$\rho \cdot g \cdot h1$" of the liquid surface of the ink 54 in the upstream ink tank 801. The sign $\rho$ ($kg/m^3$) is the density of the ink 54. The sign g ($m/s^2$) is the gravitational acceleration of the ink 54. The sign h1 (m) is a position of the liquid level (negative value) of the ink 54 in the upstream ink tank 801 with reference to the position of the openings of the nozzles 51 in the height direction, and is referred to as a "potential head". The absolute value is a potential head difference.

The upstream ink tank 801 is provided immediately close to the ink jet head 501*a*. The upstream ink flow channel 802 which connects the upstream ink tank 801 and the ink jet head 501*a* has a thick and short shape to the maximum. In other words, a flow channel resistance of the upstream ink flow channel 802 is made as small as possible. Since the flow channel resistance of the upstream ink flow channel 802 is small, fluctuations of consumption of the ink 54 discharged from the nozzles 51 are substantially managed by fluctuations of the flow rate of the ink 54 in the upstream ink flow channel 802. Since the upstream ink flow channel 802 has a thick and short shape, a pressure loss and the fluctuations thereof due to the flow rate of the ink 54 flowing in the upstream ink flow channel 802 may be reduced.

The reason why the flow channel resistance in the upstream ink flow channel 802 is made as small as possible will be described in a little more detail below. Here, about the circulating type ink supply system 2 which allows the ink 54 to flow from the upstream ink tank 801, the upstream ink flow channel 802, the nozzle branch portions 53 of the ink jet head 501*a*, the downstream ink flow channel 803, and the downstream ink tank 804 in this sequence stationarily will be seen in terms of the consumption of the ink 54 at the nozzle branch portions 53.

The amount of consumption of the ink 54 in the nozzle branch portions 53 corresponds to the amount of the ink 54 discharged from the nozzles 51. When contents of printing by the ink jet head 501*a* are changed, the amount of consumption of the ink 54 of the nozzle branch portions 53 fluctuates.

In order to discharge the ink 54 stably from the nozzles 51, it is preferable to keep the pressure of the nozzle branch portions 53 without change when the above-described fluctuations occur. In order to do so, a pressure source impedance viewed from the nozzle branch portions 53 may be lowered.

The pressure source impedance is a magnitude of the pressure fluctuation with respect to the fluctuation of the amount of consumption of the ink 54 at the nozzle branch portions 53.

The circulating type ink supply system 2 may be regarded as a parallel flow channel configured to supply the ink 54 from the two pressure sources of the upstream ink tank 801 and the downstream ink tank 804 to the nozzle branch portions 53 via the two flow channel resistances of the upstream ink flow channel 802 and the downstream ink flow channel 803 respectively. In other words, the pressure source impedance is a value which is obtained by arranging the flow resistance of the upstream ink flow channel 802 and the flow resistance of the downstream ink flow channel 803 in parallel.

Here, assuming that a total flow channel resistance from the upstream ink tank 801 to the downstream ink tank 804 is constant, the higher the ratio between the flow resistance of the upstream ink flow channel 802 and the flow resistance of the downstream ink flow channel 803 is, the lower the pressure source impedance becomes.

In this embodiment, the upstream ink tank 801 is provided at a position close to the nozzles 51. Since the flow channel resistance of the upstream ink flow channel 802 is lowered taking precedence over the flow channel resistance of the downstream ink flow channel 803, the pressure source impedance is lowered. Therefore, the pressure at the nozzle branch portions 53 is stabilized, and the ink 54 from the nozzles 51 is stably discharged. In other words, a state in which the arrangement of the nozzles 51 and the ink 54 in the upstream ink tank 801 is close thereby advantageous in piping is preferable.

Here, when the flow channel resistance of the downstream ink flow channel 803 is smaller taking precedence over the flow channel resistance of the upstream ink flow channel 802, the ratio between the flow channel resistance of the upstream ink flow channel 802 and the flow channel resistance of the downstream ink flow channel 803 is increased. Under such conditions as well, the pressure source impedance may be lowered.

However, in general, it is more realistic to reduce the flow channel resistance of the upstream ink flow channel 802 taking precedence over the flow channel resistance of the downstream ink flow channel 803. The reason is as described below.

The downstream ink flow channel 803 is connected to the downstream ink tank 804. The energy per unit volume at the liquid level of the ink 54 in the downstream ink tank 804 is needed to be lower than the energy per unit volume at the liquid level of the ink 54 in the upstream ink tank 801. In order to realize this, one of measures such as installing the downstream ink tank 804 to a position lower than the upstream ink tank 801 to reduce its potential energy or depressurizing to lower the pressure energy is necessary.

To provide the downstream ink tank 804 at the position lower than the upstream ink tank 801 means that the downstream ink tank 804 is arranged farther from the ink jet head 501*a* in comparison with the upstream ink tank 801. Therefore, lowering of the flow channel resistance of the downstream ink flow channel 803 becomes difficult. It is because that a depressurizing mechanism, not shown, is required to depressurize to lower the pressure energy.

Therefore, in this embodiment, a design such that the path length of the upstream ink flow channel 802 is shorter than the path length of the downstream ink flow channel 803 is employed.

Figure 11:
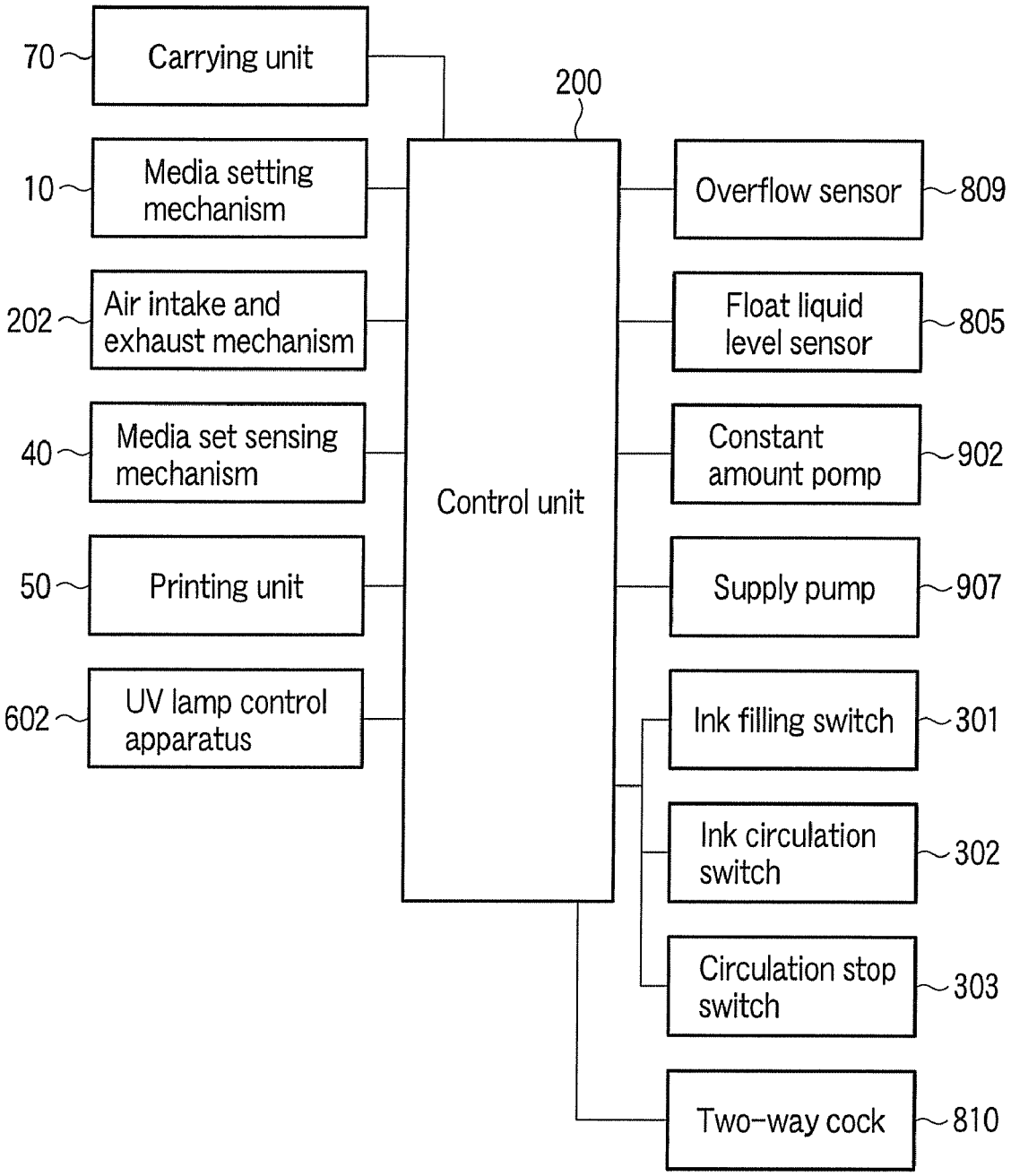
FIG. 11 is a block diagram showing a control system of the circulating type ink supply system according to the embodiment.

Referring now to FIG. 4, a process to fill the ink 54 in the entire part of the circulating type ink supply system 2 will be described. FIG. 11 is a block diagram showing a control system of the circulating type ink supply system 2.

When a user presses an ink filling switch 301 provided on the ink jet printing apparatus 1 downward, the control unit 200 checks the float liquid level sensor 805. If the float liquid level sensor 805 senses that the position of the liquid level of the ink 54 in the upstream ink tank 801 does not reach the predetermined position of the liquid level, the control unit 200 activates the supply pump 907 until the position of the liquid level in the upstream ink tank 801 reaches the predetermined position of the liquid level. At this time, the control unit 200 brings the air valve 806 to a released state. If the float liquid level sensor 805 detects that the position of the liquid level of the ink 54 in the upstream ink tank 801 reaches the predetermined position of the liquid level, the control unit 200 stops the supply pump 907. In other words, the supply pump 907 is kept in a state of being controlled so that the position of the liquid level detected by the float liquid level sensor 805 matches the predetermined position of the liquid level stably.

Subsequently, the control unit 200 brings the air valve 806 into a closed state to activate the supply pump 907. Subsequently, the control unit 200 brings the two-way cock to the opened state. The two-way cock may be switched manually by the user between the opened state and the closed state. The control unit 200 activates the constant amount pump 902. The constant amount pump 902 fills the ink 54 into the downstream ink tank 804 via the ink jet head 501*a* from the upstream ink tank 801. The downstream ink tank 804 is initially in an empty state.

An operation to open the two-way cock 810 and an operation to activate the constant amount pump 902 may be performed at any time from an initial time point of a filling operation of the ink 54 in the circulating type ink supply system 2 to a time point where the ink 54 reaches the nozzle branch portions 53 of the ink jet head 501*a*.

The constant amount pump 902 feeds air in the downstream ink tank 804 to the main tank 80 while the position of the liquid level of the ink 54 in the downstream ink tank 804 reaches the position of the intake port 901*a*. Since the ink 54 flows from the upstream ink tank 801 toward the downstream ink tank 804, the position of the liquid level of the ink 54 in the downstream ink tank 804 rises. If the position of the liquid level of the ink 54 in the downstream ink tank 804 reaches the position of the intake port 901*a*, the constant amount pump 902 feeds the ink 54 in the downstream ink tank 804 to the main tank 80. Since the position of the liquid level of the ink 54 in the downstream ink tank 804 is maintained at the position of the intake port 901*a*, the filling of the ink 54 in the circulating type ink supply system 2 is completed at this point.

Here, the pressure applied to the ink 54 (hereinafter, referred to as a nozzle pressure) at the position of the openings of the nozzles 51 from when the ink 54 reaches the nozzles 51 of the ink jet head 501*a* until it is filled in the downstream ink flow channel 803 is a positive pressure. If the nozzle pressure is the positive pressure, the ink 54 might leak from the nozzles 51. If the ink 54 leaks from the nozzles 51, the ink 54 is wasted by an amount corresponding to the leaked amount. In addition, if the ink 54 leaks from the nozzles 51, the ink 54 causes a problem of contamination of the periphery of the ink jet head 501*a*. In order to reduce the amount of the ink 54 leaked from the nozzles 51 or to prevent the ink 54 from leaking, one or more of the following operations may be performed.

A first operation is to set a highest point of the upstream ink flow channel 802 and a highest point of the downstream ink flow channel 803 to positions as low as possible. Accordingly, a pressure required for the ink 54 to pass through the highest point may be maintained at a lower level, so that the maximum pressure to be applied to the nozzles 51 may further be lowered.

A second operation is to set the flow rate of the supply pump 907 to a level as low as possible within a range that allows the ink 54 to pass through the highest point of the downstream ink flow channel 803 from when the ink 54 reaches the nozzles 51 until when the ink 54 is filled in the downstream ink flow channel 803.

A third operation is to perform a maintenance in advance so that the ink 54 is not adhered to a portion around the nozzles 51 as needed. When the ink 54 is not present around the nozzles 51, the ink 54 is able to form protruding hemispherical shaped meniscuses at the openings of the nozzles 51. Therefore, even though the nozzle pressure is not a negative pressure, but the positive pressure on the order of 1 to 2 kPa, the ink 54 does not run down from the nozzles 51.

A fourth operation is to close the surface having the openings of the nozzles 51 formed thereon hermetically by a cap or the like. If the surface is hermetically closed by the cap, even though the ink 54 leaks from the nozzles 51, the internal pressure of the cap is increased, so that the ink 54 does not leak any longer.

Incidentally, if the distance between the nozzle branch portions 53 and the nozzles 51 is long, and if the structure of the flow channel between the nozzle branch portions 53 and the nozzles 51 is complicated, air might stay between the nozzle branch portions 53 and the nozzles 51. In order to remove the air between the nozzle branch portions 53 and the nozzles 51, a purging operation might be effective. When purging of the ink 54 from the nozzles 51 is desired, the control unit 200 may perform one of operations shown below in a latter half of, or after the completion of filling of the ink 54 by the circulating type ink supply system 2.

A first method is to increase the flow rate of the supply pump 907. A second method is to close the two-way cock 810 for a predetermined period. A third method is to provide the air valve 806 on the atmosphere released side with a positive air pressure from the outside to bring the air valve 806 into an opened state.

Figure 5:
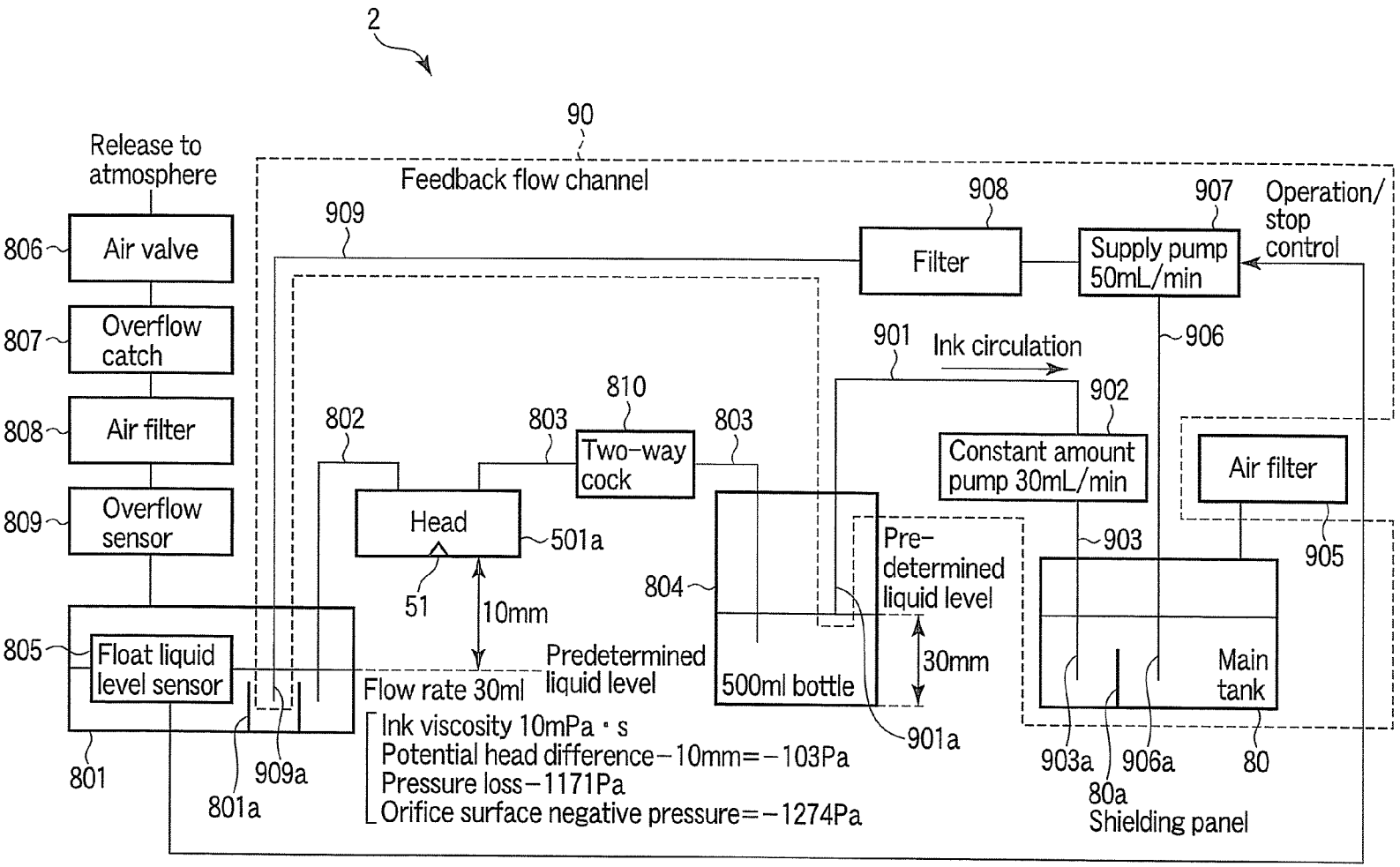
FIG. 5 is a block diagram showing a circulating process of the ink in the circulating type ink supply system according to the embodiment.

Referring now to FIG. 5, a circulating process of the ink 54 in the circulating type ink supply system 2 will be described.

First of all, the pressure of the liquid surface of the ink 54 in the upstream ink tank 801 is kept in a state released to the atmospheric pressure. (If the ink 54 has volatility, the volatilization may be restrained by providing an atmosphere released portion of the upstream ink tank 801 with a labyrinth structure and forming a saturated ink vapor-pressure device. It is also possible to hermetically seal the ink 54 in a flexible bag and provide the bag with the atmospheric pressure from the outside.) When the user presses an ink circulation switch 302 provided in the ink jet printing apparatus 1 downward, the control unit 200 brings the two-way cock 810 in the opened state.

The control unit 200 constantly controls the supply pump 907 to operate or stop according to data on the position of the liquid level of the ink 54 in the upstream ink tank 801 that the float liquid level sensor 805 senses. Subsequently, the control unit 200 activates the supply pump 907. The supply pump 907 is driven at a predetermined flow rate and, if the position of the liquid level of the ink 54 in the upstream ink tank 801 becomes lower than the predetermined position of the liquid level, air is fed and hence the liquid level is raised, so that the liquid level is maintained at the predetermined position.

The constant amount pump 902 is recommended to operate first at a flow rate larger than a target flow rate by approximately 10% to 50%. When the target flow rate is 30 mL/min, the constant amount pump 902 operates continuously for one minute at a flow rate of, for example, 40 mL/min initially. While the constant amount pump 902 is operated at 40 mL/min continuously for one minute, the liquid level of the ink 54 in the downstream ink tank 804 is stabilized at a level of the intake port 901*a* of the first flow channel 901.

One minute after the operation of the constant amount pump 902, the constant amount pump 902 operates with the flow rate lowered to the target flow rate (30 mL/min). When the constant amount pump 902 operates with the flow rate lowered from 40 mL/min to 30 mL/min, the air pressure in the downstream ink tank 804 is moved toward the positive pressure. The liquid level of the ink 54 in the downstream ink tank 804 rises to a position slightly higher than the intake port 901*a* of the first flow channel 901 and then is stabilized. With the operation as described above, a margin is generated between the liquid level of the ink 54 in the downstream ink tank 804 and the level of the intake port 901*a*. Accordingly, even though the liquid level of the ink 54 in the downstream ink tank 804 fluctuates to some extent by vibrations or the like of the ink jet printing apparatus 1, the constant amount pump 902 does not suck the air and hence the flow rate is stabilized.

Here, the reasons why prevention of sucking of the air in the downstream ink tank 804 by the constant amount pump 902 is wanted are as follows.

A first reason is that if the constant amount pump 902 feeds the air in the downstream ink tank 804 to the main tank 80, the risk of circulation of the air bubbles generated in the main tank 80 in the ink flow channel is increased. A second reason is that if the constant amount pump 902 sucks the air, the flow rate of the ink 54 flowing in the downstream ink flow channel 803 is reduced correspondingly, so that the pressure of the nozzle 51 fluctuates. The above-described two reasons both might become causes to hinder the stable operation of the ink jet head 501*a*.

If the constant amount pump 902 is operated at a higher flow rate than the target flow rate once, additional advantages as follows are also achieved. If the foreign substances such as air bubbles or particles exist in the ink 54 and reach the ink jet head 501*a*, the stable operation of the ink jet head 501*a* is hindered.

Whether the foreign substances are flushed to the downstream side or not depends on the flow rate. For example, if the foreign substances such as the air bubbles or the particles are attached to a position where the velocity of flow is low such as near a wall surface of the ink flow channel, the foreign substances can hardly be flushed. However, if the foreign substances are flowed into the ink jet head 501*a* by any chance such as vibrations, the stable operation is hindered. Here, the flow rate is increased once to flush more foreign substances to the downstream side. If the foreign substances flushed to the downstream side are gas, they are released to an air layer in the respective tanks sometime, or blocked by the filter 908.

The foreign substances remaining in the flow channel after one minute are foreign substances which cannot be moved by the flow rate of 40 mL/min. These foreign substances have less probability to move when the constant amount pump 902 is operated at 30 mL/min, which is the target flow rate, so that the probability that the foreign substances flow into the ink jet head 501*a* by any chance during the printing operation is reduced.

The value of the flow rate 40 mL/min and the value of one minute of duration period of the constant amount pump 902 might be adjusted as needed while viewing effects.

The ink jet printing apparatus 1 starts a printing job as needed when the circulation of the ink 54 in the circulating type ink supply system 2 is stabilized after the flow rate of the constant amount pump 902 is set to 30 mL/min. After the printing job is ended, the constant amount pump 902 does not necessarily have to stop the circulation of the ink 54.

While the constant amount pump 902 is in operation in the circulating type ink supply system 2, the supply pump 907 operates or stops according to the amount of the ink 54 discharged from the ink jet head 501*a* during the printing job.

Even though the ink jet head 501*a* discharges the ink 54 during the printing job, if the supply pump 907 is adequately controlled, the circulating type ink supply system 2 is stably maintained in a normal condition. By setting the flow rate of the supply pump 907 to a value larger than the sum of the circulating flow rate and the amount of consumption of the ink 54 required for printing that the ink jet head 501*a* discharges, the constant amount pump 902 may accommodate to both the time of activation and stopping thereof with an allowance.

For example, if the circulating flow rate is 30 mL/min and the maximum amount of ink consumption consumed at the ink jet head 501*a* during the printing job is 10 mL/min, the flow rate of the supply pump 907 not lower than 40 mL/min is applicable. In this embodiment, the supply pump 907 is set to 50 mL/min with an allowance.

Subsequently, the embodiment shown above will be described with concrete setting values. The liquid level of the ink 54 in the upstream ink tank 801 is 10 mm below the potential head of the nozzles 51 of the ink jet head 501*a* in the height direction. Here, the ink 54 is a UV-cured ink in this embodiment. The specific gravity of the ink 54 is 1.05.

The energy per unit volume of the ink 54 in the upstream ink tank 801 is "$\rho \cdot g \cdot h1$", which is the potential pressure of the liquid surface of the ink 54 in the upstream ink tank 801 with reference to the ink 54 in the atmospheric pressure at the position of the openings of the nozzles 51. The density $\rho$ of the ink 54 is 1050 kg/m$^3$. The gravitational acceleration g is 9.8 N/kg. The potential head difference h1 is −0.01 m. With reference to the atmospheric pressure at the position of the openings of the nozzles 51, the energy per unit volume of the ink 54 in the upstream ink tank 801 is about −103 Pa.

In other words, when the control unit 200 stops the circulation of the ink 54 and the two-way cock 810 provided in the downstream ink flow channel 803 of the ink 54 is in the closed state, the nozzle pressure is maintained at a weak negative pressure of −103 Pa. The nozzle pressure does not exceed the atmospheric pressure, that is, not exceed 0 Pa. Such event that the ink 54 runs down from the nozzles 51 or exudes therefrom does not occur. The surface of the ink 54 at the position of the each opening of the nozzle 51 maintains the meniscus curved inwardly of the opening, as shown in FIG. 3.

Figure 6:
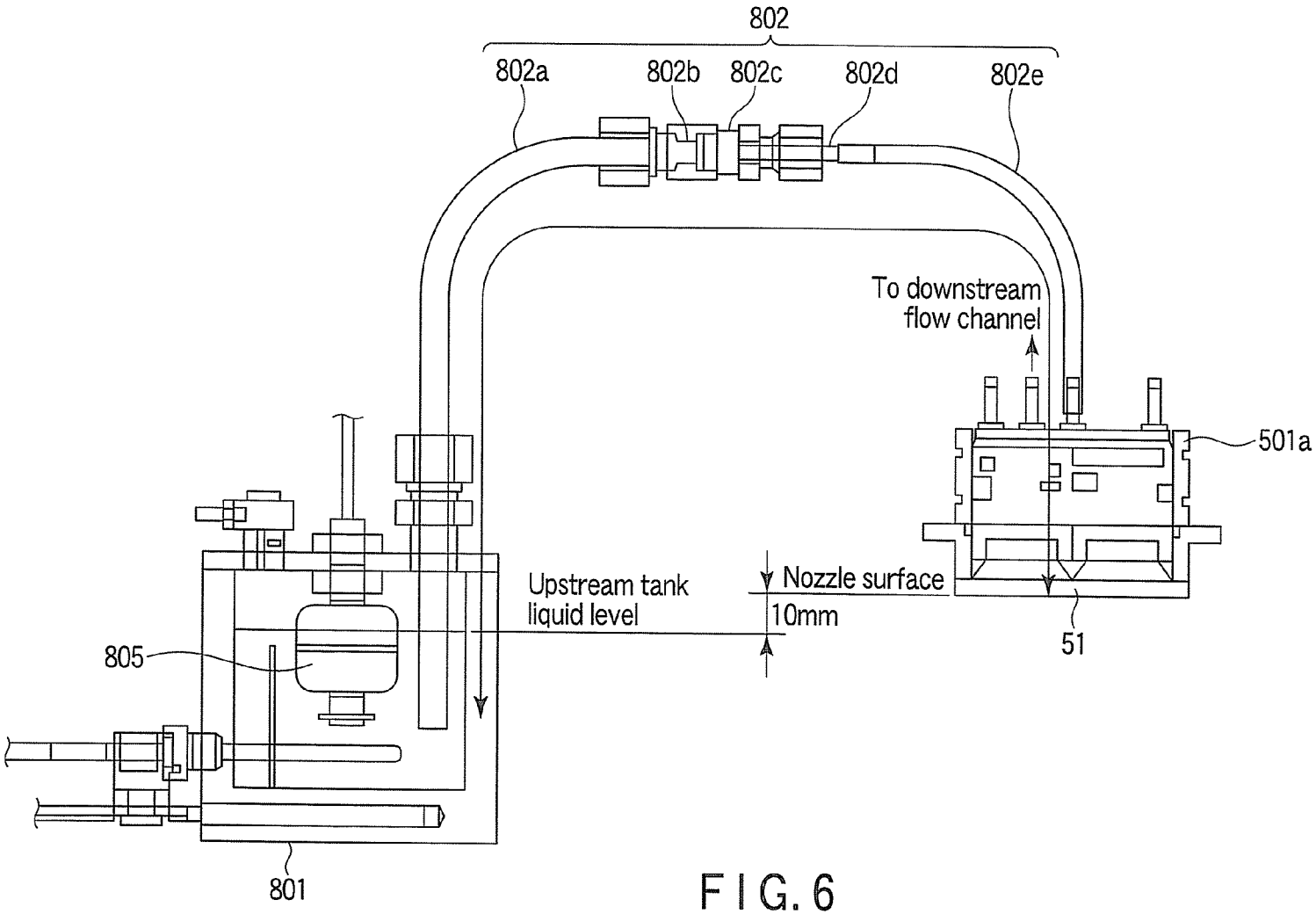
FIG. 6 is a cross-sectional front view of an upstream ink flow channel experimentally used in the circulating type ink supply system according to the embodiment.

FIG. 6 is a cross-sectional front view showing the upstream ink tank 801, the upstream ink flow channel 802, and the ink jet head 501*a* of the circulating type ink supply system 2.

The upstream ink flow channel 802 includes an SUS tube 802*a*, an interior 802*b* of a first fitting, an interior 802*c* of a second fitting, an in-fitting tube 802*d*, and a Teflon tube 802*e* from the upstream ink tank 801 to the ink jet head 501*a*. FIG. 7 is a table in which the shapes of the SUS tube 802*a*, the interior 802*b* of the first fitting, the interior 802*c* of the second fitting, the in-fitting tube 802*d*, and the Teflon tube 802*e* and the calculated theoretical values of the flow channel resistance per viscosity are shown. The flow channel resistance R (Pa·s/m$^3$) is proportional to the viscosity $\mu$ (Pa·s). The coefficient of proportion (flow channel resistance per viscosity, 1/m$^3$) is determined by the shape of the flow channel. If the Raynolds number is small, the flow channel resistance of a tube having a cross-sectional area A (m$^2$), a wet edge length s(m), and a tube length L(m) is $R(Pa \cdot s/m^3)=2k\,(S^2/A^2)\cdot L\cdot\mu$.

However, k is a tube friction coefficient ratio determined by the shape of the cross-section. In the circular tube, k=1, and the expression shown above matches the Hagen-Poiseuille's expression. In this embodiment, the circular tube is employed. In this embodiment, the Reynolds number is sufficiently small.

When the pressure loss is calculated on the basis of the flow channel resistance per viscosity actually measured on the upstream side in the ink jet head 501*a* and the flow channel resistance per actually measured viscosity (10 mPa·s) of the ink 54 and the viscosity calculated in FIG. 7, the following results as shown in FIG. 8 are obtained.

The control unit 200 brings the two-way cock 810 into the opened state before starting the circulation of the ink 54. Subsequently, when the constant amount pump 902 is driven at 30 mL/min (30 mL/min is 5E$^{-7}$ m$^3$/s) and is stabilized, the ink 54 flows from the upstream ink tank 801 to the downstream ink tank 804 at a flow rate of 30 mL/min. The ink 54 is stored in the downstream ink tank 804. The potential head difference is −10 mm=−0.01 m. The flow channel resistance is a product of the flow channel resistance per viscosity and the ink viscosity. The pressure loss is a product of the flow channel resistance and the flow rate. The pressure loss by the upstream ink flow channel 802 is about 1171 Pa.

The potential pressure of the liquid surface of the ink 54 in the upstream ink tank 801 by the potential head difference is about −103 Pa as obtained before. Therefore, the pressure applied to the nozzles 51 on an orifice surface of the ink jet head 501*a* during the circulation of the ink 54 is about −1274 Pa, which is a sum value of the values described above. In other words, the nozzle pressure is lowered by the flow channel resistance of the upstream ink flow channel 802, and the nozzle pressure becomes a negative pressure adequate for discharging the ink 54 (adequate negative pressure) −1274 Pa. The nozzle pressure (−1274 Pa) when the ink 54 is circulating is lower than the nozzle pressure (−103 Pa) when the circulation of the ink 54 is stopped.

As shown in FIG. 3, the surface of the ink 54 at the position of the openings of the nozzles 51 is formed with meniscuses having an adequate recessed shape. Consequently, satisfactory ink 54 discharging characteristics of the ink jet head 501*a* are obtained. The ink jet head 501*a* performs the printing job in this state.

In the experiment, if the circulating flow rate was 37.6 mL/min, the pressure applied to the nozzles 51 was −1230 Pa. As described above, when assuming that the circulating flow rate was 30 mL/min, the pressure applied to the nozzles 51 was assumed to be about −1274 Pa, the result of experiment almost matched the estimation by calculation.

The pressure loss by the upstream ink flow channel 802 is increased if the flow rate is increased. If the circulating flow rate of the ink 54 is set to be larger than 30 mL/min, the liquid level of the ink 54 in the upstream ink tank 801 is adjusted to be higher so that the absolute value of the potential head difference is smaller than 0.01 m in order to obtain a pressure applied to the nozzles 54 adequate to the discharge of the ink 54.

The nozzle pressure adequate to the discharge of the ink 54 is somewhat different depending on the values of the physical properties or discharging amount of the used ink 54, the physical dimensions of the nozzles 51, and the control sequence of the discharging operation. However, it normally falls within a range from about −500 Pa to about −3000 Pa. The negative pressure suitable for the discharge of the ink 54 may be adjusted to a desired value by adjusting the circulating flow rate or the position of the liquid level of the ink 54 in the upstream ink tank 801.

The calculating expression of the nozzle pressure Pn is as follows. The energy per unit volume of the ink 54 in the upstream ink tank 801 is expressed by ph (Pa) with reference to the ink 54 at the atmospheric pressure at the position of the opening of the nozzles 51. The flow channel resistance of the upstream flow channel from the upstream ink tank 801 to the nozzle branch portions 53 is expressed by $R(Pa \cdot s/m^3)$. The flow rate of the ink 54 flowing in the upstream flow channel from the upstream ink tank 801 to the nozzle branch portions 53 is expressed by $Q(m^3/s)$. If Pn(Pa) is established, the pressure applied to the nozzles 51 adequate to the discharge of the ink 54 is in the relation of ph−QR=Pn. The values of ph, R, and Q may be adjusted to make the value of Pn a predetermined value.

Subsequently, the pressure change during the printing job is considered. The lower part of FIG. 8 is a table showing the pressure loss when printed from the state of circulating the ink 54 as shown in the upper part of FIG. 8. If the flow rate of the supply pump 907 is 30 mL/min, the flow rate on the upstream side becomes the flow rate 40 mL/min in which a flow rate of 10 mL/min discharged from the nozzles 51 is superimposed on a circulating flow rate of 30 mL/min automatically. The pressure loss by the upstream ink flow channel 802 is about −1562 Pa. The potential pressure of the liquid surface of the ink 54 in the upstream ink tank 801 by the potential head difference is about −103 Pa as obtained before. Therefore, the pressure applied to the nozzles 51 on the orifice surface of the ink jet head 501*a* during the circulation of the ink 54 is about −1665 Pa, which is a sum value of the above-described values The pressure change when the flow rate of the ink 54 flowing upstream side of the ink jet head 501*a* is changed during the printing job is −1274 Pa−(−1562 Pa)≈390 Pa.

From this value, the pressure loss by the interior of the ink jet head 501*a* is −985 Pa−(−1313 Pa)≈328 Pa. The pressure loss by the upstream ink flow channel 802 is 390 Pa−328 Pa=62 Pa.

The downstream ink tank 804 functions as the buffer tank in which the air layer in the interior serves as the damper. In this embodiment, the downstream ink tank 804 is a bottle having a capacity of 500 mL.

The reason why the downstream ink tank 804 is used is as follows. Assuming that the constant amount pump 902 is connected directly with the ink jet head 501*a*, the pressure applied to the nozzles 51 changes abruptly in proportion to the pulsation of the pump. Therefore, the ink jet head 501*a* is adversely affected.

Since the downstream ink tank 804 is provided between the ink jet head 501*a* and the constant amount pump 902, the pulsation generated by the constant amount pump 902 is absorbed by the air layer of the downstream ink tank 804. In other words, the flow of the ink 54 flowing in the circulating type ink supply system 2 is smoothened. In this manner, the downstream ink tank 804 serves to flow the ink 54 at a constant flow rate from the downstream ink tank 804 while restraining the pulsation of the constant amount pump 902.

The inventors conducted a comparative experiment for confirming the effect of the downstream ink tank 804 which absorbs the pulsation of the constant amount pump 902 as follows. FIG. 12B has a configuration of an experimental apparatus in which the downstream ink tank 804 as damper used and FIG. 12A has a configuration of an experimental apparatus in which the downstream ink tank 804 is omitted. The upstream ink tank 801 and the main tank 80 are released to the atmosphere. The downstream ink tank is a bottle of 500 mL, which is the same as the downstream ink tank 804 in FIG. 4 and FIG. 5, is hermetically closed.

Figure 12A:
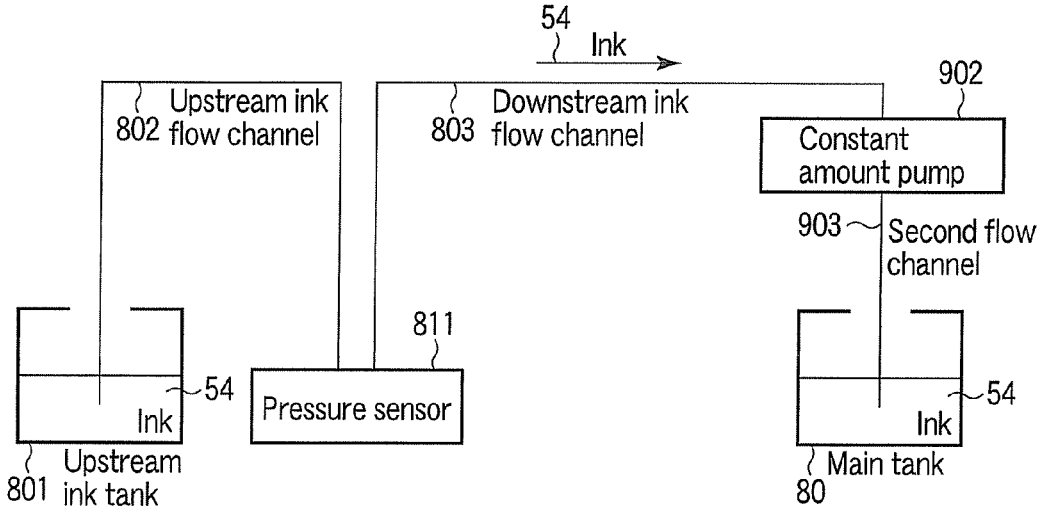
FIG. 12A is a block diagram showing an experimental apparatus using the downstream ink tank for confirming the effect that the downstream ink tank absorbs the pulsation of the constant amount pomp.
Figure 12B:
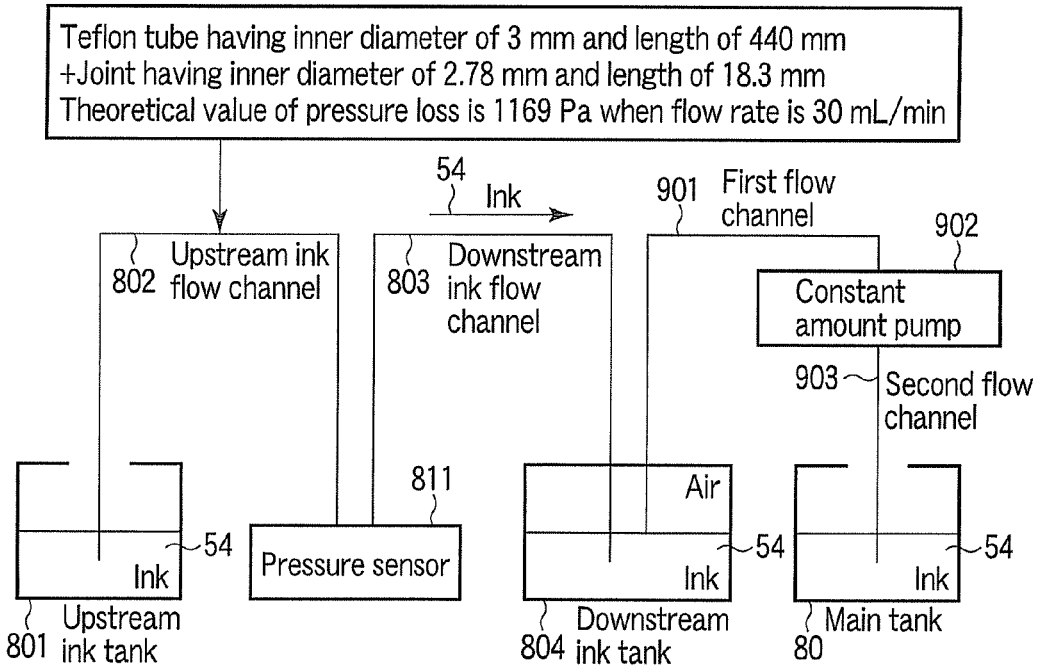
FIG. 12B is a block diagram showing the experimental apparatus without using the downstream ink tank for confirming the effect that the downstream ink tank absorbs the pulsation of the constant amount pomp.

In FIG. 12A, the ink 54 is fed along a path from the upstream ink tank 801 through the upstream ink flow channel 802, the pressure sensor 811, the downstream ink flow channel 803, the downstream ink tank 804, the first flow channel 901, the diaphragm constant amount pump 902, the second flow channel 903 to the main tank 80. In FIG. 12A, since the downstream ink tank 804 is omitted, the ink 54 is fed along the path from the upstream ink tank 801 through the upstream ink flow channel 802, a pressure sensor 811, the downstream ink flow channel 803, the diaphragm constant amount pump 902, the second flow channel 903 to the main tank 80.

The diaphragm constant amount pump 902 is the same member as the constant amount pump 902 in FIG. 4 and FIG. 5, and is manufactured by SATACO LTD., SNF-10TT24PSCUV type. This diaphragm constant amount pump 902 is capable of feeding both liquid and gas.

The upstream ink flow channel 802 is adjusted in tube length so that the flow channel resistance substantially matches the flow channel resistance on the upstream side in FIG. 4 and FIG. 5. As a result of adjustment, a tube having an inner diameter of 3 mm and a length of 440 mm is used. When the flow rate of the ink is 30 mL/min, the theoretical value of the pressure loss generated by the flow channel resistance of the upstream ink flow channel 802 is 1169 Pa. The pressure sensor 811 is a wet negative pressure meter.

Figure 9A:
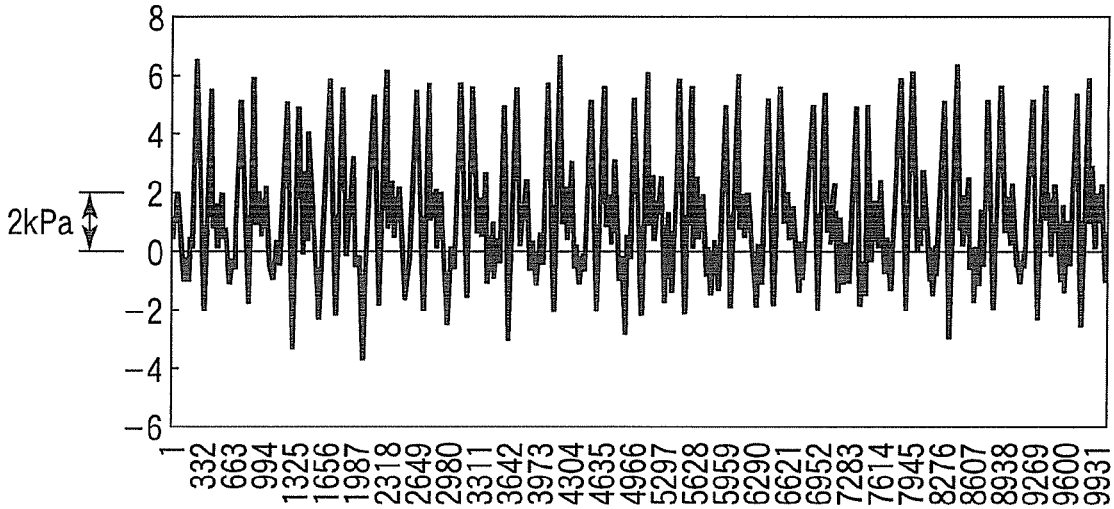
FIG. 9A is a graph of an actual measurement of pulsations of a constant amount pump when the downstream ink tank is not hermetically closed according to the embodiment.

In this experiment, since comparing the change amounts of the pressure is objective, the magnitude is not controlled. Therefore, the absolute values in the result of measurement are meaningless, and the width of fluctuations has a meaning. A read value of the pressure sensor 811 measured by the experimental apparatus shown in FIG. 12A is shown in FIG. 9A. The unit of numerical values represented by the vertical axis of this graph is kPa. From this graph, it is understood that the pressure fluctuations of about 10 kPa at maximum occur.

Figure 9B:
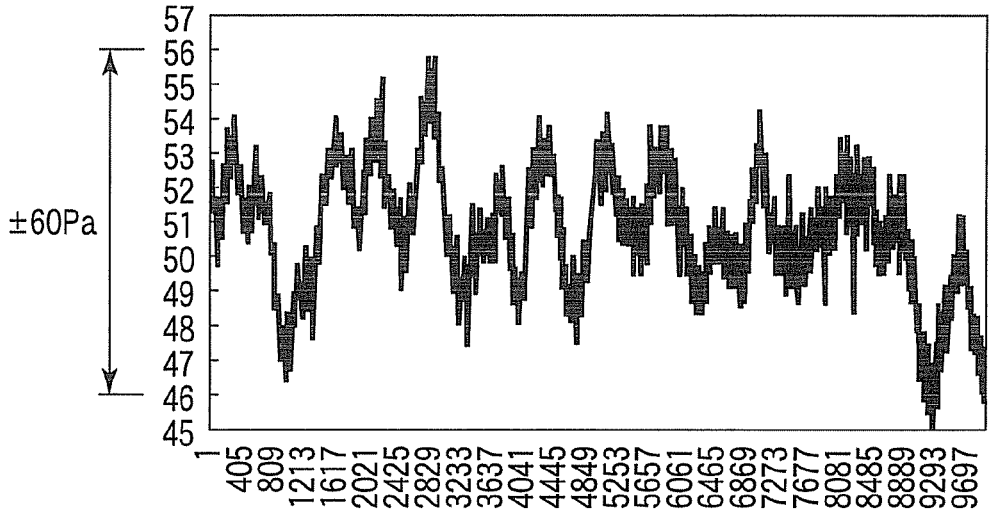
FIG. 9B is a graph of the actual measurement of pulsations of the constant amount pump when the downstream ink tank is hermetically closed according to the embodiment.

In contrast, if the measurement is performed by the experimental apparatus shown in FIG. 12B, the read value of the pressure sensor 811 is as shown in FIG. 9B. The unit of numerical values represented by the vertical axis of FIG. 9B is ×10 Pa. The width of the pressure fluctuations read from the graph is 120 Pa. For example, a recommended range of negative pressure of the general ink jet head 501*a* manufactured by Toshiba TEC Corporation is from −533 Pa to −2000 Pa, so that an adaptable range of 1467 Pa is secured. In the configuration in FIG. 12A, in which the downstream ink tank 804 is not provided, the width of the pressure fluctuations exceeds the adaptable range. Therefore, even though the pressure is adjusted, a normal printing is not achieved. However, with the configuration shown in FIG. 12B, the width of the pressure fluctuations is sufficiently smaller than the adaptable range, so that the normal printing is achieved by adjusting the pressure adequately.

The intake port 901*a* of the first flow channel 901 is provided at the predetermined position of the downstream ink tank 804. The first flow channel 901 is a flow channel of the ink 54 which extends from the intake port 901*a* to the constant amount pump 902. The constant amount pump 902 is a pump of a constant flow rate such as a diaphragm pump or a tube pump, and is capable of feeding any of gas and liquid.

The constant amount pump 902 exhausts the air in the downstream ink tank 804 and introduces the ink 54 from the upstream ink tank 801 to the downstream ink tank 804 via the downstream ink flow channel 803 while the quantity of the ink 54 in the downstream ink tank 804 is small such as the time of filling the ink 54. If the liquid level of the ink 54 in the downstream ink tank 804 is increased to a level not lower than the level of the intake port 901*a*, the constant amount pump 902 exhausts the ink 54 in the downstream ink tank 804 at the constant flow rate. The constant amount pump 902 simultaneously introduces the ink 54 from the upstream ink tank 801 to the downstream ink tank 804 via the downstream ink flow channel 803 at the same constant flow rate. In this manner, the downstream ink tank 804 is brought into a stationary state. The constant amount pump 902 returns the ink 54 discharged from the downstream ink tank 804 to the main tank 80.

When the liquid level of the ink 54 in the downstream ink tank 804 is lower than the level of the intake port 901*a*, the constant amount pump 902 feeds gas (air) in the downstream ink tank 804 to the main tank 80, so that the liquid level rises. In this manner, the liquid surface of the downstream ink tank 804 is maintained at a constant value. Here, it is not preferable that the gas fed by the constant amount pump 902 enters the feedback flow channel 90 including the supply pump 907. In the main tank 80, a shielding panel 80*a* is provided between a discharge port 903*a* provided in the second flow channel 903 on the side of the main tank 80 and an intake port 906*a* provided in the third flow channel 906 on the side of the main tank 80.

The shielding panel 80*a* is at a level not lower than the levels of the discharge port 903*a* and the intake port 906*a*. Instead of the shielding panel 80*a*, it is also possible to provide a decelerating mechanism configured to increase the surface area of the flow channel and decelerate the velocity of flow per flow rate at the discharge port 903*a* to make the gas to float. Alternatively, a method of providing the discharge port 903*a* at a position higher than the position of the intake port 906*a* to prevent the air bubbles from passing from the constant amount pump 902 to the supply pump 907 or a method combining two or more methods described above may also be applicable.

In the same manner, it is desirable to provide a decelerating mechanism 801*a* or the like also at a discharge port 909*a* provided on the side of the upstream ink tank 801 of the fourth flow channel 909. The decelerating mechanism 801*a* is a cylindrical partition having a cross-sectional area except for a portion overlapping with the discharge port 909*a* larger than the discharge port 909*a*, and is configured to reduce the velocity of flow of the ink 54 according to the ratio of the cross-sectional area and cause the air bubbles to float.

In this manner, by configuring in such a manner that the gas is removed on the side of the upstream ink tank 801, granted that the gas passes through the feedback flow channel 90 and reaches the upstream ink tank 801, the gas is prevented from being fed to the ink jet head 501*a*.

The air layer in the main tank 80 is released to the atmospheric pressure via the air filter 905. When the ink 54 has volatility, the air filter 905 may be provided with the labyrinth structure to form the saturated ink vapor-pressure device to restrain the volatility, or the ink 54 may be hermetically sealed in a flexible bag and provided with the atmospheric pressure from the outside of the bag.

Since the upstream ink tank 801 is hermetically closed, even though the ink 54 has volatility, it does not evaporate more than the requirement for saturation.

The main tank 80 is connected to the supply pump 907 via the third flow channel 906. The supply pump 907 sucks the ink 54 from the main tank 80, filters the same with the filter 908 and causes the ink 54 to circulate to the upstream ink tank 801. The flow rate of the supply pump 907 is set to an amount higher than the sum of the flow rate of the constant amount pump 902 and the flow rate of the ink 54 discharged from the nozzles 51 for the printing job.

The upstream ink tank 801 is provided with the float liquid level sensor 805. If the liquid level of the ink 54 in the upstream ink tank 801 is lower than the predetermined position of the liquid level, the control unit 200 that senses an output of the float liquid level sensor 805 transmits a drive start signal to the supply pump 907. The supply pump 907 feeds the ink 54 to the upstream ink tank 801. The liquid level of the ink 54 in the upstream ink tank 801 rises. If the liquid level of the ink 54 in the upstream ink tank 801 reaches a level not lower than the predetermined position of the liquid level, the control unit 200 transmits a drive stop signal to the supply pump 907. The supply pump 907 stops the operation.

The range of application of the circulating type ink supply system 2 according to this embodiment is not limited to the ink jet printing apparatus 1 shown in FIG. 1. It may be an image forming apparatus such as a multifunction peripheral (MFP).

In addition, for example, the circulating type ink supply system 2 is applicable to an apparatus in which a paper feed tray supplies a paper to a carrier belt unit by a roller, the carrier belt unit carries the paper adsorbed by suction or static electricity onto a carrier belt to a front surface of the ink jet head 501*a*, the ink jet head 501*a* prints on the paper, and a member such as a separating claw separates the paper from the carrier belt and discharges the same.

Figure 13:
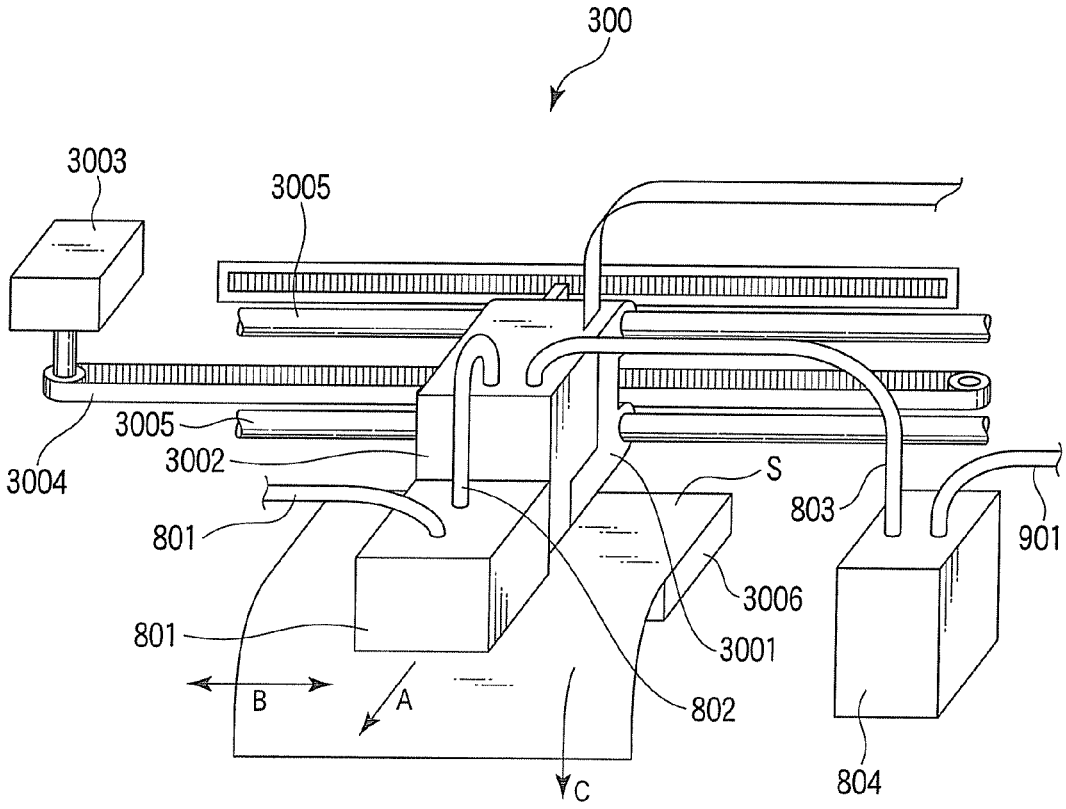
FIG. 13 is a schematic view showing a serial printing apparatus to which the circulating type ink supply system according to the embodiment is applied.
Figure 14:
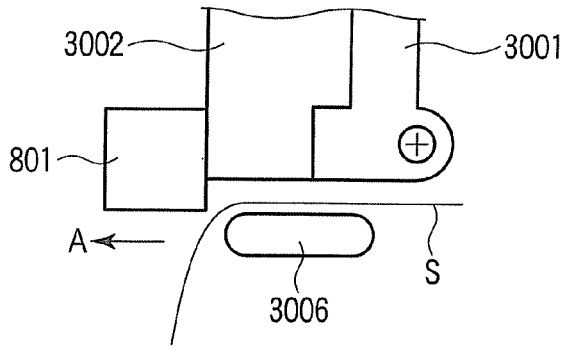
FIG. 14 is a side view showing the serial printing apparatus to which the circulating type ink supply system according to the embodiment is applied.

For example, the circulating type ink supply system 2 may be applied to a continuous printing apparatus in which the fixed ink jet head 501*a* prints on a roll paper. FIG. 13 is a schematic drawing showing a serial printing apparatus 300 to which the circulating type ink supply system 2 is applicable. FIG. 14 is a side view showing the serial printing apparatus 300 to which the circulating type ink supply system 2 is applicable. For example, the circulating type ink supply system 2 is also applied to the serial printing apparatus 300 in which the printing on a sheet S is performed while scanning with an ink jet head 3002 mounted on a carriage 3001 in a direction B, which is orthogonal to the paper feeding direction A. The same reference numerals as in the embodiment described above will not be described. The upstream ink tank 801 is mounted on the carriage 3001 and is provided on the downstream side of the ink jet head 3002 along the paper feeding direction A. A motor 3003 transmits a rotational drive to the carriage 3001 via a timing belt 3004. The ink jet head 3002 reciprocates in the direction B along a carriage guide 3005 together with the carriage 3001. The sheet S is carried in the paper feeding direction A in a state of being guided by a guide member 3006. The sheet S moves along a direction of movement C by its own weight or a carrying member, not shown, after being printed by the ink jet head 3002.

In general, with the serial printing apparatus 300, it is difficult to achieve both the stability of the nozzle pressure and the weight reduction of the carriage 3001. In order to make the nozzle pressure to be stabilized, it is necessary to mount a flow channel component which allows ink to flow to the nozzles of the ink jet head 3002 immediately close to the ink jet head 501*a*, that is, on the carriage 3001. There is a problem such that if the weight of the carriage 3001 increases by a number of components mounted thereon, the carriage 3001 cannot be operated easily.

When mounting the circulating type ink supply system 2 according to this embodiment on the serial printing apparatus 300, only the upstream ink tank 801 needs to be mounted on the carriage 3001. The reason is as described below. The flow rate of the ink flowing in the downstream flow channel 803 is always kept at a constant value determined by the set flow rate of the constant amount pump 902, and is not affected by the flow rate of the discharged ink. In other words, a constant flow rate flow channel (like a constant current circuit) is formed on the downstream side, and the pressure source impedance is set to a very high value. Therefore, even though the flow channel resistance in the downstream flow channel fluctuates, the nozzle pressure is not affected. In view of this point, the circulating type ink supply system 2 according to this embodiment can be considered to be an optimum ink supply system for the serial printing apparatus 300.

In this embodiment, the liquid level of the ink 54 in the upstream ink tank 801 is set to a level lower than the position of the openings of the nozzles 51. When the ink jet head 501*a* prints downward, the paper as the printing medium is normally positioned under the ink jet head 501*a*. Therefore, there might be a case where positioning of the liquid level in the upstream ink tank 801 to a position lower than the openings of the nozzles 51 is difficult.

In such a case, an application to set the liquid level of the ink 54 in the upstream ink tank 801 to a position slightly higher than the surface of the nozzles 51 is also possible. In such a case, the circulating flow rate may be increased to a level higher than that in this embodiment during the circulation of the ink 54 to shift the nozzle pressure to the negative pressure side. Although the nozzle pressure becomes a positive pressure when the circulation is stopped, if it is a positive pressure not higher than 1 to 2 kPa, the ink 54 is prevented from running down by performing maintenance to clean the surface of the nozzles 51.

If the liquid level of the ink 54 in the upstream ink tank 801 is set to a level slightly higher than the position of the openings of the nozzles 51, it is more preferable to provide a negative pressure air tank as a separate component and connect the atmosphere released portion of the air valve 806 to the negative pressure air tank instead of releasing to the atmosphere. It is because the negative pressure can be maintained even while the circulation is stopped if the negative pressure air tank is provided.

Figure 10:
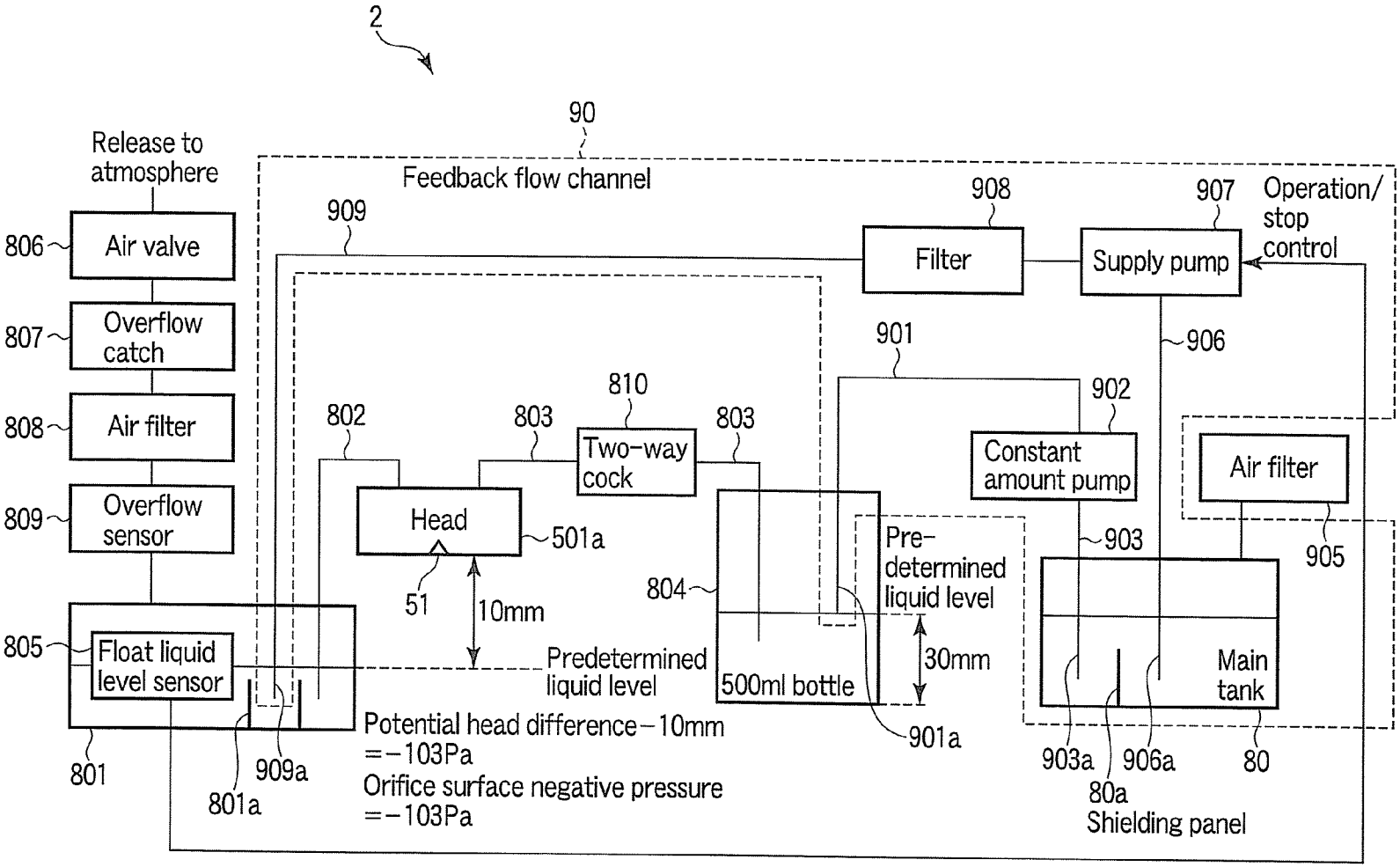
FIG. 10 is a block diagram for explaining a circulation stopping process of the ink in the circulating type ink supply system according to the embodiment.

Referring now to FIG. 10, a circulation stopping process of the ink 54 in the circulating type ink supply system 2 will be described.

First of all, when the user presses the circulation stop switch 303 provided on the ink jet printing apparatus 1 downward, the control unit 200 stops the constant amount pump 902. Then, the pressure in the downstream ink tank 804 is gradually increased and the flow rate is reduced. In the mean time, since the supply pump 907 is controlled to bring the liquid level in the upstream ink tank 801 to a predetermined value, the frequency of stopping of the supply pump 907 increases. Subsequently, the control unit 200 brings the two-way cock 810 to the closed state. When the two-way cock 810 assumes the closed state, the circulation of the ink 54 is stopped. Therefore, the amount of the ink 54 in the upstream ink tank 801 is not reduced any longer. As a result, the supply pump 907 does not operate. Subsequently, the control to operate and stop the supply pump 907 may be stopped.

In the state in which the circulation is stopped and the state in which the printing is stopped, the energy per unit volume of the ink 54 in the upstream ink tank 801 is determined by the potential pressure on the basis of the potential head difference from the potential head to the position of the liquid level of the ink 54 in the upstream ink tank 801. In this embodiment, the energy per unit volume of the ink 54 in the upstream ink tank 801 is −103 Pa. The nozzle pressure is maintained at a weak negative pressure of −103 Pa also after the circulation is stopped. Therefore, there is no probability such that the periphery of the nozzles 51 gets wet by the ink 54 or the ink 54 runs down from the nozzles 51.

Here, the reason why the two-way cock 810 is brought into the closed state when the circulation is stopped is for preventing the position of the liquid level of the ink 54 in the upstream ink tank 801 from changing by a siphon effect caused by the upstream ink tank 801 being brought into communication with the downstream ink tank 804 and the main tank 80.

The position to insert the two-way cock 810 may be in series with the constant amount pump 902. When any one or a plurality of measures shown below are implemented, the installation of the two-way cock 810 might be omitted (constantly opened).

A first measure is to cause the control unit 200 not to stop the supply pump 907 and constantly control the liquid level in the upstream ink tank 801 to a constant value. A second measure is to use a member having a restraining mechanism such as a tube pump as the constant amount pump 902. A third measure is to set the liquid level of the ink 54 in the main tank 80 to a level higher than the liquid level of the ink 54 in the downstream ink tank 804, and to provide a check valve configured to stop the flow in the direction from the main tank 80 toward the downstream ink tank 804 in series with the constant amount pump 902.

While the two-way cock 810 is in the closed state, if the hermeticity of the downstream ink flow channel 803 including the two-way cock 810 is worried, the control to operate and stop the supply pump 907 after the circulation is stopped as well may be continued in order to maintain the liquid level in the upstream ink tank 801 at a predetermined liquid level.

According to this embodiment, the maintenance of the circulating type ink supply system 2 does not have to be performed frequently. Since the nozzle pressure is maintained at an adequate negative pressure, the ink 54 does not leak from the nozzles 51 and, in contrast, the air does not enter from the nozzles 51. Therefore, the ink jet printing apparatus 1 may be used in sequence for the activation of the circulating type ink supply system 2, the circulation of the ink 54 by the circulating type ink supply system 2, and the printing with the circulating type ink supply system 2. Basically, the purging and the maintenance of the circulating type ink supply system 2 are not necessary. It is proved by the experiment that there is no problem even though the circulating type ink supply system 2 is activated in a state in which the circulation of the ink 54 is stopped for eight days in the circulating type ink supply system 2.

What is claimed is:

1. A circulating type ink supply system comprising:

an upstream ink tank;

an upstream ink flow channel connected at one end thereof to the upstream ink tank;

a nozzle branch portion connected to the other end of the upstream ink flow channel and being in communication with a nozzle configured to discharge ink;

a downstream ink flow channel connected at one end thereof to the nozzle branch portion;

a downstream ink tank connected to the other end of the downstream ink flow channel and configured to store the ink flowed from the upstream ink tank via the upstream ink flow channel, the nozzle branch portion, and the downstream ink flow channel;

a feedback flow channel configured to return the ink in the downstream ink tank to the upstream ink tank;

a circulating mechanism configured to circulate the ink stored in the upstream ink tank from the upstream ink flow channel through the nozzle branch portion, the downstream ink flow channel, the downstream ink tank, and the feedback flow channel to the upstream ink tank; and a printing mechanism configured to discharge the ink branched at the nozzle branch portion from the nozzle portion for printing, wherein: with reference to ink at an atmospheric pressure at a level of the nozzle, an energy per unit volume, which is determined by a sum value of a static pressure and a potential energy of the ink in the upstream ink tank, both when the circulation of the ink is stopped and when the circulating mechanism operates does not exceed an energy per unit volume of the referenced ink.

2. The system of claim 1, wherein: a position of the liquid level of the upstream ink tank is not higher than a level of the nozzle.

3. The system of claim 1, wherein: a first pressure applied to the ink at the nozzle portion when the ink is circulating is lower than a second pressure applied to the ink at the nozzle portion, the second pressure being equal to 0 or lower than 0 when the circulation of the ink is stopped.

4. The system of claim 1, wherein: the pressure applied to the ink at the nozzle portion when the ink is circulating and the pressure of the ink at the nozzle portion when the circulation of the ink is stopped satisfy a relation of 0 Pa (the atmospheric pressure)=>the pressure applied to the ink at the nozzle portion when the circulation of the ink is stopped=>the pressure applied to the ink at the nozzle portion when the ink is circulating=>−3000 Pa.

5. The system of claim 1, wherein: a relation ph−QR=Pn is satisfied where ph(Pa) is an energy per unit volume of the ink in the upstream ink tank with reference to the energy per unit volume of the ink at the atmospheric pressure at the level of the nozzle, R(Pas/m.sup.3) is a flow channel resistance of the upstream ink channel, Q(m.sup.3/s) is a flow rate of the ink flowing in the upstream ink flow channel, and Pn(Pa) is a pressure applied to the ink at the nozzle position suitable for discharging the ink, and wherein the value Pn satisfies a relation of 500 Pa =<−Pn =<3000 Pa.

6. A circulating type ink supply system comprising:

an upstream ink tank;

an upstream ink flow channel connected at one end thereof to the upstream ink tank;

a nozzle branch portion connected to the other end of the upstream ink flow channel and being in communication with a nozzle configured to discharge ink;

a downstream ink flow channel connected at one end thereof to the nozzle branch portion;

a downstream ink tank connected to the other end of the downstream ink flow channel and configured to store the ink flowed from the upstream ink tank via the upstream ink flow channel, the nozzle branch portion, and the downstream ink flow channel;

a feedback flow channel configured to return the ink in the downstream ink tank to the upstream ink tank;

a circulating mechanism configured to circulate the ink stored in the upstream ink tank from the upstream ink flow channel through the nozzle branch portion, the downstream ink flow channel, the downstream ink tank, and the feedback flow channel to the upstream ink tank;

and a printing mechanism configured to discharge the ink branched at the nozzle branch portion from the nozzle for printing, wherein: the flow channel resistance of the upstream ink flow channel is lower than the flow channel resistance of the downstream ink flow channel.

7. The system of claim 6, wherein at least the upstream ink tank, the upstream ink flow channel, and the printing mechanism are mounted on a carriage, and at least the downstream ink tank is installed at a position separate from the carriage.

8. The system of claim 6, wherein: a path length of the upstream ink flow channel is shorter than a path length of the downstream ink flow channel.

9. The system of claim 6, wherein: a distance from the position of the nozzle branch portion to the position of the upstream ink tank is shorter than a distance from the position of the nozzle branch portion to the downstream ink tank.

10. The system of claim 6, wherein: the feedback flow channel includes a main tank configured to store the ink, a constant amount pump configured to suck the ink from the downstream ink tank and feed the same to the main tank, and a supply pump configured to suck the ink in the main tank and returns the same to the upstream ink tank.

11. The system of claim 6, wherein: the feedback flow channel includes a filter configured to filter the ink.

12. The system of claim 10, wherein: the main tank includes an inlet port for allowing the ink to flow in by the constant amount pump and a discharge port configured to discharge the ink by the supply pump, and a shielding panel is provided between the inlet port and the discharge port.

13. The system of claim 6, wherein: the downstream ink flow channel is provided with a cock configured to stop the flow of the ink.

14. The system of claim 10, comprising:

a liquid level sensor configured to detect the liquid level in the upstream ink tank; and a control mechanism configured to control the supply pump according to the result of detection of the liquid level sensor and maintain the liquid level in the upstream ink tank to a predetermined level in the upstream ink tank.

15. The system of claim 14, wherein: the constant amount pump sucks gas in the downstream ink tank via a discharge port provided at the predetermined level of the downstream ink tank while the liquid level in the downstream ink tank is lower than the predetermined level, and sucks the ink while the liquid level in the downstream ink tank is not lower than the predetermined level in the downstream ink tank so that the liquid level in the downstream ink tank is maintained constant.

16. The system of claim 14, wherein: the downstream ink tank is a hermetically closed damper bottle and the constant amount pump sucks gas in the downstream ink tank via a discharge port provided at the predetermined level of the downstream ink tank while the liquid level in the downstream ink tank is lower than the predetermined level, and sucks the ink while the liquid level in the downstream ink tank.

17. A circulating type ink supply system comprising:

an upstream ink tank;

an upstream ink flow channel connected at one end thereof to the upstream ink tank;

a nozzle branch portion connected to the other end of the upstream ink flow channel and being in communication with a nozzle configured to discharge ink;

a downstream ink flow channel connected at one end thereof to the nozzle branch portion;

a downstream ink tank connected to the other end of the downstream ink flow channel and configured to store the ink flowed from the upstream ink tank via the upstream ink flow channel, the nozzle branch portion, and the downstream ink flow channel;

a feedback flow channel configured to return the ink in the downstream ink tank to the upstream ink tank; a circulating mechanism configured to circulate the ink stored in the upstream ink tank from the upstream ink flow channel through the nozzle branch portion, the downstream ink flow channel, the downstream ink tank, and the feedback flow channel to the upstream ink tank;

a printing mechanism configured to discharge the ink branched at the nozzle branch portion from the nozzle for printing; and a carriage which moves in a direction orthogonal to a paper feeding direction and mounts at least the upstream ink tank, the upstream ink flow channel, and the printing mechanism, wherein the downstream ink flow channel is controlled to be a constant flow rate flow channel.

18. A liquid feeding mechanism comprising:

a hermetically closed buffer tank configured to receive liquid flowing inward from a supply port thereof and discharge the liquid and gas from a discharge port provided at a predetermined level; and a pump connected to the discharge port and configured to feed both the liquid and the gas, wherein: the pump discharges the gas from the discharge port provided on the buffer tank and allows the liquid to flow inward from the supply port to fill the liquid to the predetermined level in the buffer tank while the position of the liquid level in the buffer tank does not reach the predetermined level, and discharges the liquid from the discharge port provided on the buffer tank and allows the liquid to flow inward from the supply port while the liquid level of the liquid in the buffer tank reaches a level not lower than the predetermined level.

19. The liquid feeding mechanism of claim 18, wherein the pump is controlled to feed the liquid or gas at a first flow rate for a predetermined time, and subsequently to feed the liquid or gas at a second flow rate less than the first flow rate.

* * * * *